US012162581B2

(12) United States Patent
Blackburn et al.

(10) Patent No.: US 12,162,581 B2
(45) **Date of Patent: *Dec. 10, 2024**

(54) STEERING CONTROL SYSTEM FOR PERSONAL WATERCRAFTS

(71) Applicant: BRP Megatech Industries Inc., Valcourt (CA)

(72) Inventors: Alexandre Blackburn, Notre-Dame-du-Mont-Carmel (CA); Jean-Francois Lahaye, Saint-Hyacinthe (CA); Lionel Thiebault, Shawinigan (CA); Simon Bedard, St-Elie-de-Caxton (CA); Luc St-Pierre, Shawinigan (CA)

(73) Assignee: BRP Megatech Industries Inc., Valcourt (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/360,952

(22) Filed: Jul. 28, 2023

(65) Prior Publication Data

US 2024/0002029 A1 Jan. 4, 2024

Related U.S. Application Data

(63) Continuation of application No. 17/417,081, filed as application No. PCT/IB2019/061319 on Dec. 23, 2019, now Pat. No. 11,738,846.

(Continued)

(51) Int. Cl.

| | |
|---|---|
| ***B63H 25/02*** | (2006.01) |
| ***B63H 21/21*** | (2006.01) |
| ***B63H 25/46*** | (2006.01) |

(52) U.S. Cl.

CPC ..... *B63H 25/02* (2013.01); *B63H 21/213* (2013.01); *B63H 25/46* (2013.01); *B63H 2021/216* (2013.01); *B63H 2025/024* (2013.01)

(58) Field of Classification Search

CPC ..... B63H 25/00; B63H 25/02; B63H 25/46; B63H 21/00; B63H 21/213; B63H 2021/216; B63H 2025/024

(Continued)

(56) References Cited

U.S. PATENT DOCUMENTS

| | | | |
|---|---|---|---|
| 5,244,426 | A | 9/1993 | Muyashita et al. |
| 6,077,135 | A | 6/2000 | Ito |

(Continued)

FOREIGN PATENT DOCUMENTS

| | | | |
|---|---|---|---|
| DE | 10248343 | A1 | 8/2003 |
| EP | 1268258 | B1 | 6/2008 |

(Continued)

OTHER PUBLICATIONS

English language abstract for DE 10248343 A1 extracted from espacenet.com database on Jul. 1, 2021, 1 page.

(Continued)

*Primary Examiner* — Lars A Olson
(74) *Attorney, Agent, or Firm* — BCF LLP

(57) ABSTRACT

A personal watercraft, driving control system, and method for controlling the watercraft. The watercraft includes a jet powered propulsion system; a steering system including a handle; and the driving control system including an electrically actuated device coupled to the steering system for applying torque to the steering system; at least one sensor positioned adjacent the steering system; and a controller. The controller is configured to: determine whether user torque is being applied to the steering system; and responsive to determining that the user torque is not being applied: determine a steering angle; determine a target angle for returning the steering system to a center position; compare the steering angle to the target angle; determine a centering torque; and operate the electrically actuated device to apply (Continued)

the centering torque to the steering, with the centering torque being applied only by the electrically actuated device.

20 Claims, 13 Drawing Sheets

Related U.S. Application Data

(60) Provisional application No. 62/783,743, filed on Dec. 21, 2018.

(58) Field of Classification Search
USPC ..... 114/144 R
See application file for complete search history.

(56) References Cited

U.S. PATENT DOCUMENTS

| | | | | |
|---|---|---|---|---|
| 6,138,596 | A | 10/2000 | Gonring et al. | |
| 6,336,833 | B1 | 1/2002 | Rheault et al. | |
| 6,604,479 | B2 | 8/2003 | McKenney et al. | |
| 6,668,796 | B2 | 12/2003 | Umemoto | |
| 6,675,730 | B2 | 1/2004 | Simard et al. | |
| 7,018,252 | B2 | 3/2006 | Simard et al. | |
| 9,650,121 | B2 | 5/2017 | Kinoshita | |
| 10,000,269 | B2 | 6/2018 | Burk et al. | |
| 11,738,846 | B2 * | 8/2023 | Blackburn ..... | B63H 25/02 114/144 R |
| 2003/0187558 | A1 | 10/2003 | Zheng et al. | |
| 2004/0011585 | A1 | 1/2004 | Menjak et al. | |
| 2004/0029459 | A1 | 2/2004 | Berthiaume et al. | |
| 2004/0173135 | A1 | 9/2004 | Watanabe et al. | |
| 2005/0199168 | A1 | 9/2005 | Mizutani | |
| 2005/0199169 | A1 | 9/2005 | Mizutani | |
| 2008/0096445 | A1 | 4/2008 | Nanami | |
| 2008/0119094 | A1 | 5/2008 | Mizutani et al. | |
| 2017/0029085 | A1 | 2/2017 | Burk et al. | |
| 2018/0335780 | A1 | 11/2018 | Stevens et al. | |

FOREIGN PATENT DOCUMENTS

| | | | |
|---|---|---|---|
| JP | 2003-127979 | A | 5/2003 |
| JP | 2004-284574 | A | 10/2004 |
| JP | 2007-203841 | A | 8/2007 |
| JP | 2011-174500 | A | 9/2011 |
| KR | 100702171 | B1 | 3/2007 |
| WO | 2018185528 | A1 | 10/2018 |

OTHER PUBLICATIONS

English language abstract for KR 100702171 B1 extracted from espacenet.com database on Jul. 1, 2021, 1 page.

International Search Report for Application No. PCT/IB2019/061319 dated Apr. 2, 2020, 4 pages.

International Search Report for Application No. PCT/IB2020/052037 dated Nov. 12, 2020, 3 pages.

Communication Pursuant to Article 94(3) EPC issued from the European Patent Office on Jul. 4, 2023 during the prosecution of corresponding EP application No. 19842408.7.

Youtube, "Sea-Doo Fish Pro Review—Long Haul, Ep. 35", Nov. 9, 2018, 3 pages.

* cited by examiner

STEERING CONTROL SYSTEM FOR PERSONAL WATERCRAFTS

CROSS-REFERENCE

This application is a continuation of U.S. patent application Ser. No. 17/417,081, filed Jun. 21, 2021, which is a National Stage Entry of International Patent Application No. PCT/IB2019/061319, which claims priority to U.S. Provisional Application Ser. No. 62/783,743, filed Dec. 21, 2018, the disclosure of each of which is hereby incorporated by reference in its entirety.

TECHNICAL HELD

Aspects of this disclosure generally relate to managing steering control of personal watercrafts.

BACKGROUND

The steering system of a typical personal watercraft (PWC) provides little feedback to a driver when performing a turn. This lack of feedback may be interpreted by the driver as a lack of control, which can lead to dangerous conditions such as unintended sharp cornering, swerving, and collisions.

SUMMARY

In one example, a personal watercraft includes a jet powered propulsion system, a steering system coupled to the jet powered propulsion system that includes a handle for adjusting an angle of the jet powered propulsion system relative a longitudinal axis of the personal watercraft, and a driving control system coupled to the steering system. The driving control system includes an electrically actuated device coupled to the steering system for applying torque to the steering system, at least one sensor positioned adjacent the steering system that generates operational data of the personal watercraft, and at least one controller coupled to the electrically actuated device and the at least one sensor. The at least one controller is configured to determine a first torque to apply to the steering system based on the operational data responsive to a rotation of the handle, and to operate the electrically actuated device to apply the first torque to the steering system for providing enhanced steering control of the personal watercraft, with the first torque being applied only by the electrically actuated device.

In another example, a driving control system for enhancing steering control of a jet powered personal watercraft including a jet powered propulsion system and a steering system coupled to the jet powered propulsion system, the steering system including a handle for adjusting an angle of the jet powered propulsion system relative to a longitudinal axis of the personal watercraft, includes an electrically actuated device adapted to be coupled to the steering system of the jet powered personal watercraft. The electrically actuated device is for applying torque to the steering system. The driving control system also includes at least one sensor adapted to be positioned adjacent the steering system when the electrically actuated device is coupled to the steering system that generates operational data of the jet powered personal watercraft, and at least one controller coupled to the electrically actuated device and the at least one sensor. The at least one controller is configured to determine a first torque to apply to the steering system based on the operational data responsive to a ration of the handle, and operate the electrically actuated device to apply the first torque to the steering system for providing enhanced steering control of the jet powered personal watercraft, with the first torque being applied only by the electrically actuated device.

In a further example, a method for enhancing steering control of a jet powered personal watercraft including a jet powered propulsion system, a steering system coupled to the jet powered propulsion system that includes a handle for adjusting the angle of the jet powered propulsion system relative to a longitudinal axis of the jet powered personal watercraft, an electrically actuated device coupled to the steering system for applying torque to the steering system, and at least one sensor positioned adjacent the steering system that generates operational data of the jet powered personal watercraft, includes receiving a rotation of the handle, and determining a first torque to apply to the steering system for the jet powered personal watercraft based on the operational data responsive to the rotation of the handle. The method further includes operating the electrically actuated device to apply the first torque to the steering system for providing enhanced steering control of the jet powered personal watercraft, with the first torque being applied only by the electrically actuated device.

According to an aspect of the present technology, there is provided a personal watercraft including a jet powered propulsion system; a steering system coupled to the jet powered propulsion system and including a handle for adjusting an angle of the jet powered propulsion system relative a longitudinal axis of the personal watercraft; and a driving control system coupled to the steering system, the driving control system including an electrically actuated device coupled to the steering system for applying torque to the steering system; at least one sensor positioned adjacent the steering system that generates operational data of the personal watercraft; and at least one controller coupled to the electrically actuated device and the at least one sensor, the at least one controller configured to: determine whether user torque is being applied to the steering system to turn the personal watercraft; and responsive to determining that the user torque is not being applied to the steering system to turn the personal watercraft: determine a steering angle of the steering system based on the operational data; determine a target angle for the steering system for returning the steering system to a center position based on the operational data; compare the steering angle to the target angle; determine a centering torque for retuning the steering system to the center position based on the comparison, and operate the electrically actuated device to apply the centering torque to the steering system for providing enhanced steering control of the personal watercraft, with the centering torque being applied only by the electrically actuated device.

In some embodiments, the at least one controller is configured to determine the target angle for the steering system based on an engine RPM value, an engine torque request value, and a speed of the personal watercraft.

In some embodiments, the operational data is determined based on an angle and a speed of the rotation of the handle.

In some embodiments, the sensor that generates the operational data includes a steering angle sensor, the operational data including the steering angle.

In some embodiments, the at least one controller is configured to implement a feedback loop that adjusts the centering torque applied to the steering system based on updates to the current steering angle and the target angle over time.

In some embodiments, the steering system comprises a first control surface, and a second control surface, the first and second control surfaces positioned at opposed ends of an aft portion of the personal watercraft, and the at least one controller is configured to: lower the first control surface into water responsive to a rotation of the handle in a first direction; and lower the second control surface into the water responsive to a rotation of the handle in a second direction.

In some embodiments, the steering system comprises a first control surface, and a second control surface, the first and second control surfaces positioned at opposed ends of an aft portion of the personal watercraft, and the at least one controller is configured to lower at least one of the first and second control surfaces into the water, responsive to the controller determining the target angle for returning the steering system to the center position based on the operational data.

In some embodiments, the steering system includes a first control surface and a second control surface, the first and second control surfaces positioned at opposed ends of an aft portion of the personal watercraft, and the at least one controller is configured to lower the first control surface into water responsive to a rotation of the handle in a first direction and to a determination that a speed of the personal watercraft is greater than a predefined speed; and lower the second control surface into the water responsive to a rotation of the handle in a second direction and to a determination that the speed of the personal watercraft is greater than the predefined speed.

In some embodiments, the steering system includes a first control surface and a second control surface, the first and second control surfaces positioned at opposed ends of an aft portion of the personal watercraft, and the at least one controller is configured to lower at least one of the first and the second control surfaces into the water, responsive to the controller determining the target angle for returning the steering system to the center position based on the operational data and to a determination that the speed of the personal watercraft is greater than a predefined speed.

In some embodiments, the first and second control surfaces are mechanically linked to the handle, and the at least one controller is configured to operate the electrically actuated device to apply the centering torque to the steering system responsive to determining that the user torque is not being applied to the steering system to turn the personal watercraft.

In some embodiments, the personal watercraft further includes a navigation system comprising a global positioning system (GPS) module and an inertial navigation system (INS) module; and the at least one controller is configured to generate the geographic data by being configured to calibrate the INS module using the GPS module; operate the INS module to generate the geographic data for a time period; and recalibrate the INS module using the GPS module responsive to expiration of the time period.

According to another aspect of the present technology, there is provided a driving control system for enhancing steering control of a jet powered personal watercraft including a jet powered propulsion system and a steering system coupled to the jet powered propulsion system and including a handle for adjusting an angle of the jet powered propulsion system relative to a longitudinal axis of the personal watercraft. The driving control system includes an electrically actuated device adapted to be coupled to the steering system of the jet powered personal watercraft for applying torque to the steering system; at least one sensor adapted to be positioned adjacent the steering system when the electrically actuated device is coupled to the steering system that generates operational data of the jet powered personal watercraft; and at least one controller coupled to the electrically actuated device and the at least one sensor, the at least one controller configured to determine whether user torque is being applied to the steering system to turn the personal watercraft; and responsive to determining that the user torque is not being applied to the steering system to turn the personal watercraft: determine a steering angle of the steering system based on the operational data; determine a target angle for the steering system for returning the steering system to a center position based on the operational data; compare the steering angle to the target angle; determine a centering torque for retuning the steering system to the center position based on the comparison, and operate the electrically actuated device to apply the centering torque to the steering system for providing enhanced steering control of the personal watercraft, with the centering torque being applied only by the electrically actuated device.

In some embodiments, the at least one controller is configured to determine the target angle for the steering system based on an engine RPM value, an engine torque request value, and a speed of the personal watercraft.

In some embodiments, the operational data is determined based on an angle and a speed of the rotation of the handle.

In some embodiments, the sensor that generates the operational data includes a steering angle sensor, the operational data including the steering angle.

In some embodiments, the at least one controller is configured to implement a feedback loop that adjusts the centering torque applied to the steering system based on updates to the current steering angle and the target angle over time.

In some embodiments, the steering system includes a first control surface and a second control surface, the first and second control surfaces positioned at opposed ends of an aft portion of the personal watercraft, and the at least one controller is configured to lower at least one of the first and the second control surfaces into the water, responsive to the controller determining the target angle for returning the steering system to the center position based on the operational data and to a determination that the speed of the personal watercraft is greater than a predefined speed.

In some embodiments, the first and second control surfaces are mechanically linked to the handle, and the at least one controller is configured to operate the electrically actuated device to apply the centering torque to the steering system responsive to determining that the user torque is not being applied to the steering system to turn the personal watercraft.

According to another aspect of the present technology, there is provided a method for enhancing steering control of a jet powered personal watercraft including a jet powered propulsion system, a steering system coupled to the jet powered propulsion system and including a handle for adjusting an angle of the jet powered propulsion system relative to a longitudinal axis of the jet powered personal watercraft, an electrically actuated device coupled to the steering system for applying torque to the steering system, and at least one sensor positioned adjacent the steering system that generates operational data of the jet powered personal watercraft, the method comprising the steps of determining whether user torque is being applied to the steering system to turn the personal watercraft; and responsive to determining that the user torque is not being applied to the steering system to turn the personal watercraft: determining a steering angle of the steering system based on the operational data; determining a target angle for the steering system for returning the steering system to a center position based on the operational data; comparing the steering angle to the target angle; determining a centering torque for retuning the steering system to the center position based on the comparison, and operating the electrically actuated device to apply the centering torque to the steering system for providing enhanced steering control of the personal watercraft, with the centering torque being applied only by the electrically actuated device.

In some embodiments, determining the target angle for the steering system comprises determining an engine RPM value, an engine torque request value, and a speed of the personal watercraft.

DETAILED DESCRIPTION

Figure 1:
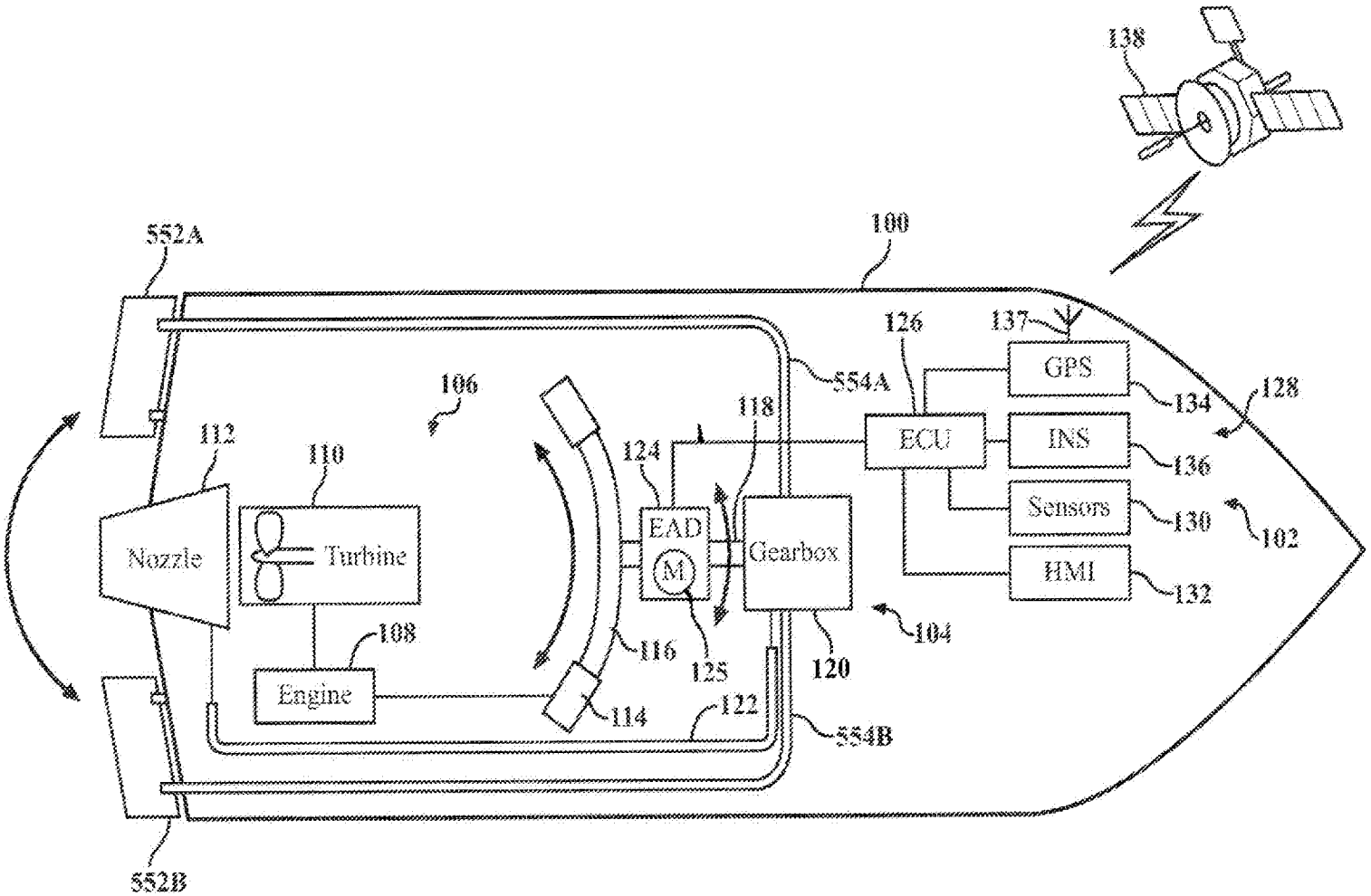
FIG. 1 is a schematic diagram illustrating the components of a personal watercraft having enhanced steering control.

Personal watercrafts (PWCs) have unique steering dynamics and a distinct driving feel owed to their small size and specific type of propulsion and steering system (e.g., water turbine interacting with steering nozzle). The typical handle of a PWC has less than a ninety-degree lock-to-lock range, such as a seventy- or eighty-degree lock-to-lock range, which offers very quick but low-resolution steering control. Conversely, small boats and automobiles often include a steering wheel having a multi-turn (e.g., three turns) lock-to-lock range, and offer high resolution steering control at the expense of increased driver involvement to generate high steering rates. Relative to small boats and automobiles, PWCs are thus typically able to be turned via very light steering effort and generate tremendous cornering forces at high speeds.

The steering system of a typical PWC provides little or no steering feedback to a driver of the forces exchanged between the watercraft and its environment, such as during a turn. Specifically, a driver of the PWC usually receives little or no resistive steering feedback from the load applied to the watercraft by environmental conditions (e.g., winds, waves), and receives little or no resistive steering feedback from the load the watercraft applies to its surrounding environment. The steering feedback provided to a driver of a typical PWC does not significantly increase with speed. Conversely, the rudder of a small boat and the drivetrain of an automobile each provides a relatively high resistive steering force that is proportional to the speed and steering angle of the vehicle. A driver of a small boat or automobile thus receives greater steering feedback than a driver of a typical PWC.

An unexperienced driver of a typical PWC, who may be used to the driving feel and steering dynamics of an automobile, may associate the lack of feedback and ease of steering with a lack of control. Feeling a lack of control can lead the driver to perform dangerous maneuvers, such as excessive steering operations at high speeds, which can potentially eject an unexpecting driver or passenger from the PWC. Moreover, the ease at which the typical PWC is turned may enable environmental elements, such as waves, wakes, and swells, to cause the PWC to constantly veer off course. Unlike with a small boat or automobile, the loads between a typical PWC and its environment are often not sufficient to provide self-centering of the PWC. The driver of a typical PWC may thus need to perform several steering corrections while the PWC is operated to maintain a particular heading.

PWCs configured to overcome these and other issues are described herein. In one example, a PWC may include a driving control system coupled to a steering system of the PWC. The driving control system may include an electrically actuated device (EAD) and an electronic control unit (ECU) coupled thereto. The EAD may be an electric power steering (EPS) system configured to apply a torque to the steering system of the PWC based on electrical signals received from the ECU.

During operation of the PWC, the driving control system may be configured to implement an active damper regulated based on various operational parameters monitored by the ECU. Specifically, the ECU may be configured to operate the EAD to apply additional resistance to the steering system of the PWC based on the monitored parameters. In this way, a driver may need to provide increased steering effort to turn the PWC, which may better inform the driver of potential forces that can be generated by the PWC responsive to a steering action. The driving feel of the PWC will thus be closer to that of a small boat or automobile, which may be more intuitive and comfortable for the driver, and may correspondingly lead to greater confidence, better steering control, and avoidance of potentially dangerous maneuvers.

FIG. 1 illustrates a PWC 100 with a driving control system 102 for providing enhanced steering control. The driving control system 102 may be coupled to and configured to interact with a steering system 104 of the PWC 100. The steering system 104 may be coupled to and configured to interact with a jet-powered propulsion system 106 of the PWC 100. The jet-powered propulsion system 106 may operate to propel the PWC 100 in a forward direction. The steering system 104 may operate to adjust the angle of the jet-powered propulsion system 106 relative to a longitudinal axis of the PWC 100, and may thereby steer the PWC 100 in a given direction.

More particularly, the jet-powered propulsion system 106 may include an engine 108, a turbine 110, a nozzle 112, and a throttle 114. The throttle 114 may be connected to a handle 116 of the PWC 100, and may be coupled to the turbine 110, such as via the engine 108. A driver may interact with the throttle 114 to cause the engine 108 to rotate the turbine 110. The speed of the PWC 100 may correspond to the rotational speed of the turbine 110, which may correspond to the extent of activation of the throttle 114 by the driver. For example, the throttle 114 may form a rotatable grip secured to the handle 116 of the PWC 100. The greater the rotation of the throttle 114, the faster the engine 108 may rotate the turbine 110, and the faster the turbine 110 may propel the PWC 100 in the forward direction.

In particular, rotation of the turbine 110 may drive water into an input end of the nozzle 112. The nozzle 112 may be configured to responsively form a hydraulic jet stream that is expressed away from the PWC 100 through an output end of the nozzle 112. The jet stream may function to propel the PWC 100 in the opposite direction of the jet stream. For example, when the nozzle 112 expresses a jet stream in a direction parallel and/or collinear to the longitudinal axis of the PWC 100 (i.e., the axis extending through the stern and the bow of the PWC 100), the jet stream may propel the PWC 100 in a straight forward direction.

The steering system 104 may include the handle 116, a steering column 118, a gearbox 120, and a main push-pull cable 122. Rotation of the handle 116 left and right may cause the PWC 100 to turn left and right respectively. Specifically, the handle 116 may be coupled to the gearbox 120 via the steering column 118. Rotation of the handle 116 by a user may cause a corresponding rotation of the steering column 118, which in turn may be received by the gearbox 120. The gearbox 120 may be coupled to the nozzle 112 via the main push-pull cable 122, and may be configured to translate a rotation of the steering column 118, such as via one or more gears, into a push or pull force onto the end of the main push-pull cable 122 connected to the gearbox 120. Responsive to the push or pull force being applied onto the connected end of the main push-pull cable 122, the other end of the main push-pull cable 122 may exert a respective push or pull force on the input end of the nozzle 112, thereby causing the output end of the nozzle 112 to pivot with respect to the longitudinal axis of the PWC 100. In alternative examples, rather than the gearbox 120, the PWC 100 may include a different mechanism, such as an armlink or an electronic actuator, between the steering column 118 and the main push-pull cable 122 that is configured to translate a rotation of the handle 116 and steering column 118 into the push or pull force onto the connected end of the main push-pull cable 122 and/or the nozzle 112.

Setting the nozzle 112 at a non-parallel angle to the longitudinal axis of the PWC 100, which may correspondingly set the jet stream at a non-parallel angle to the longitudinal axis, may cause the PWC 100 to turn in a direction corresponding to the direction of the jet stream. Specifically, as the output end of the nozzle 112 pivots away from the longitudinal axis of the PWC 100 responsive to a rotation of the handle 116 to perform a turn, the jet stream formed by the nozzle 112 may cause the hull of the PWC 100 to lean in towards the turn. The hull's geometry, which may include ridges or other fixed control surfaces, may correspondingly interact with the water on the inside of the turn. This interaction may effect turning of the PWC 100 under the power of the jet stream.

For example, a clockwise rotation of the handle 116 may cause a corresponding clockwise rotation of the steering column 118. The gearbox 120 may be configured to translate the clockwise rotation of the steering column 118 into a pull force on the main push-pull cable 122, which may responsively exert a pull force on the nozzle 112. This pull force may cause the output end of the nozzle 112 to pivot right (or counter-clockwise), thereby causing the jet stream to push the back end of the PWC 100 left and effect a right turn of the PWC 100. Similarly, a counter-clockwise rotation of the handle 116 may cause a corresponding counter-clockwise rotation of the steering column 118. The gearbox 120 may be configured to translate this counter-clockwise rotation into a push force on the main push-pull cable 122, which may responsively exert a push force on the nozzle 112. This push force may cause the output end of the nozzle 112 to pivot left, thereby causing the jet stream to push the back end of the PWC 100 right and effect a left turn of the PWC 100.

As described above, the driving control system 102 may be coupled to the steering system 104 of the PWC 100, and may be configured to provide enhanced steering control of the PWC 100. The driving control system 102 may include an electrically actuated device (EAD) 124, an electronic control unit (ECU) 126, a navigation system 128, one or more sensors 130, and a human machine interface (HMI) 132.

The EAD 124 may be coupled to the steering column 118, and may function as an electric power steering (EPS) system for the PWC 100. To this end, the EAD 124 may include a motor 125, such as an electric motor, configured to apply torque to the steering column 118 in the clockwise and counter-clockwise directions, such as based on control signals received from the ECU 126. For example, the EAD 124 may include one or more arms coupled to the steering column 118 and rotatable by the motor 125, or may include a sleeve rotatable by the motor 125 through which the steering column 118 extends and is coupled to.

The ECU 126 (also referred to herein as a "controller") may be configured to communicate with other components of the PWC 100, or more particularly of the driving control system 102, directly and/or over one or more wired or wireless networks, such as a control area network (CAN). During operation of the PWC 100, the ECU 126 may be configured to control the EAD 124 based on data received from the navigation system 128, the sensors 130, and/or the HMI 132.

The navigation system 128 may include a global positioning system (GPS) module 134 and/or an inertial navigation system (INS) module 136. The GPS module 134 and the INS module 136 may each be configured to determine and communicate to the ECU 126 data indicating the current position, heading, and velocity of the PWC 100.

The GPS module 134 may be configured to generate geographic data indicating a current position of the PWC 100 by communicating with one or more orbiting satellites 138 via a GPS antenna 137 of the GPS module 134. Each position generated by the GPS module 134 may include the longitude and latitude coordinates of the PWC 100 at a given time. The GPS module 134 or ECU 126 may further be configured to generate geographic data indicating a current heading of the PWC 100 by comparing two or more positions determined by the GPS module 134 over a set time period relative to direction of movement. The GPS module 134 or ECU 126 may also be configured to generate operational data indicating a current velocity of the PWC 100 by comparing two or more positions determined by the GPS module 134 over a set time period relative to time.

The INS module 136 may include an accelerometer, gyroscope, and/or magnetometer configured to calculate and generate data indicating the current position, orientation (e.g., heading) and velocity of the PWC 100. Specifically, based on a known geographic position of the PWC 100 at a given time, which may be determined using the GPS module 134 as described above, and on a known orientation and velocity of the PWC 100, which may be determined using the data generated by the GPS module 134 as described above and/or data generated by the INS module 136, the INS module 136 or the ECU 126 may be configured to determine an updated geographic position, heading, and velocity of the PWC 100 based on the data generated by the INS module 136 alone. In other words, the INS module 136 or ECU 126 may be configured to determine how the PWC 100 is moved relative to the previously known geographic position, heading, and/or velocity based on the data generated by the INS module 136 to determine an updated position, heading, and velocity of the PWC 100 at a given time.

The INS module 136 may enable the ECU 126 to determine the current geographic position, heading, and velocity of the PWC 100 when the GPS module 134 is unable to communicate with and receive data from the GPS satellite 138. Moreover, the ECU 126 may be configured to save power by primarily utilizing the INS module 136 as the primary source of geographic data, and utilizing data from the GPS module 134 to periodically calibrate the INS module 136 with the current geographic position, heading, and/or velocity of the PWC 100 as determined via data received from the GPS satellite 138. In other words, the ECU 126 may be configured to generate data indicating the current position, heading, and/or velocity of the PWC 100 by being configured to calibrate the INS module 136 using the GPS module 134, operate the INS module 136 to generate this data for a predefined time period, recalibrate the INS module 136 using the GPS module 134 responsive to expiration of the time period, and so on.

The sensors 130 may be configured to generate operational data indicating the current operational state of the PWC 100. For example, the sensors 130 may include a tachometer configured to generate data indicating the rotational speed of the engine 108 and/or turbine 110, a torque request sensor configured to generate data indicating the amount of torque being requested by the driver from the engine 108 and/or turbine 110 via the throttle 114 (e.g., the extent to which the driver is activating the throttle 114), and a speedometer configured to generate data indicating the current speed of the PWC 100. At least one of the sensors 130 may be positioned adjacent the steering system 104 to generate operational data indicative of a status of the steering system 104. For instance, the sensors 130 may include a steering angle sensor configured to generate data indicating a current angle of the handle 116, such as relative to a center position of the handle 116, and a torque sensor configured to generate data indicating the amount and direction of torque on the steering column 118. The ECU 126 may be configured to utilize the operational data generated by the sensors 130 to control the EAD 124. The GPS module 134 and INS module 136 may also be considered as sensors of the PWC 100 that generate operational data, such as data indicating the velocity of the PWC 100.

The HMI 132 may be positioned adjacent the handle 116, and may facilitate user interaction with the other components of the PWC 100, such as those of the driving control system 102. For example, the HMI 132 may enable user interaction with the ECU 126 and the navigation system 128 described above. The HMI 132 may include one or more video and alphanumeric displays, a speaker system, and any other suitable audio and visual indicators capable of providing data from the PWC 100 components to a user. The HMI 132 may also include a microphone, physical controls, and any other suitable devices capable of receiving input from a user to invoke functions of the PWC 100 components. The physical controls may include an alphanumeric keyboard, a pointing device (e.g., mouse), keypads, push-buttons, and control knobs. A display of the HMI 132 may be an integrated touch screen display that includes a touch screen mechanism for receiving user input.

Figure 2:
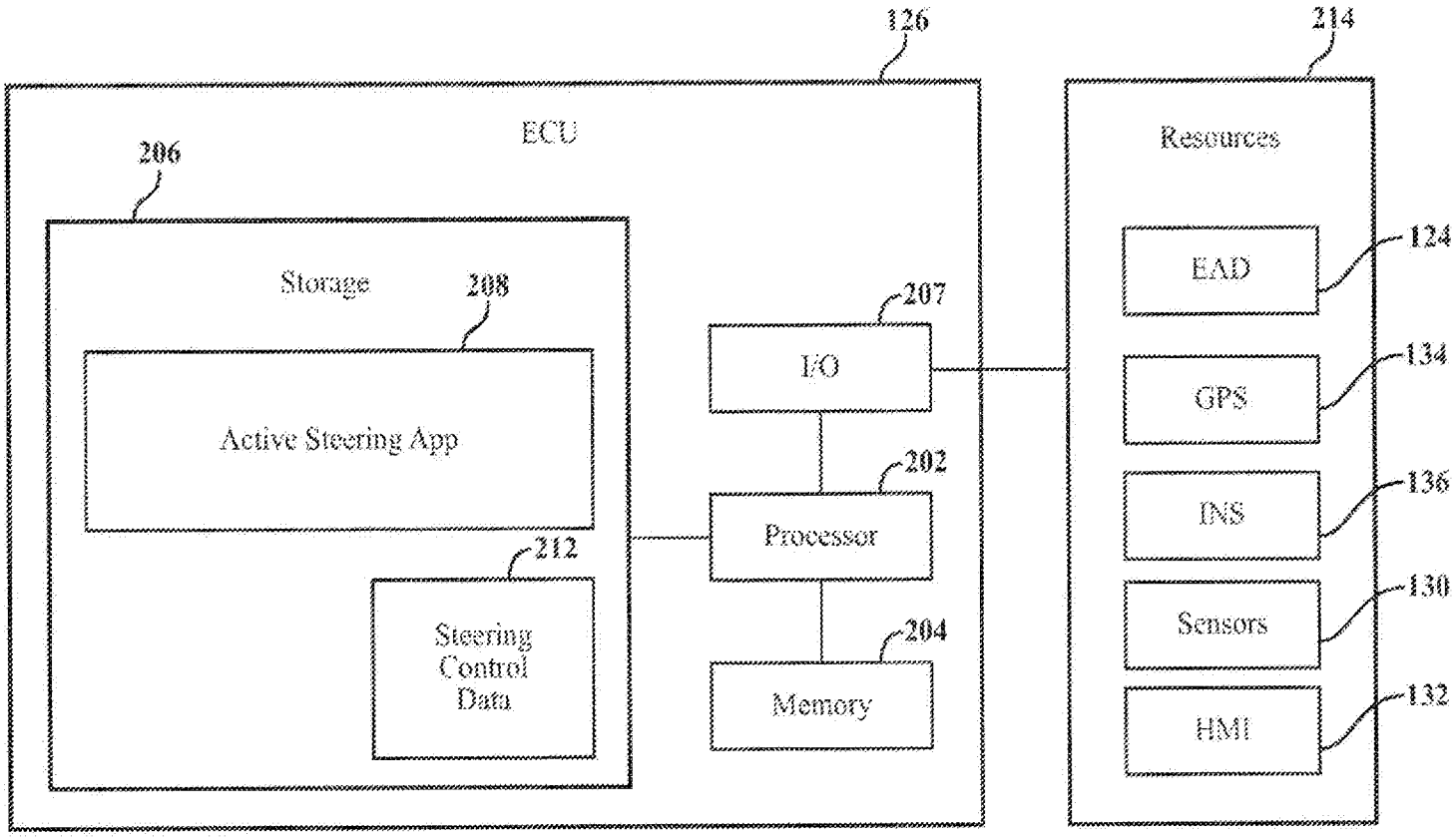
FIG. 2 is a schematic diagram illustrating a controller that may be included in the personal watercraft of FIG. 1.

Referring to FIG. 2, the ECU 126 may include a processor 202, memory 204, non-volatile storage 206, and an input/output (I/O) interface 207. The processor 202 may include one or more devices selected from microprocessors, microcontrollers, digital signal processors, microcomputers, central processing units, field programmable gate arrays, programmable logic devices, state machines, logic circuits, analog circuits, digital circuits, or any other devices that manipulate signals (analog or digital) based on operational instructions read from the non-volatile storage 206 and stored in the memory 204. The memory 204 may include a single memory device or a plurality of memory devices including, but not limited, to read-only memory (ROM), random access memory (RAM), volatile memory, non-volatile memory, static random access memory (SRAM), dynamic random access memory (DRAM), flash memory, cache memory, or any other device capable of storing information. The non-volatile storage 206 may include one or more persistent data storage devices such as a hard drive, optical drive, tape drive, non-volatile solid-state device, or any other device capable of persistently storing information.

The processor 202 may be configured to read into memory 204 and execute computer-executable instructions residing in the non-volatile storage 206. The computer-executable instructions may embody software, such as an active steering application 208, and may be compiled or interpreted from a variety of programming languages and/or technologies, including, without limitation, and either alone or in combination, Java, C, C++, C #, Objective C, Fortran, Pascal, Java Script, Python, Perl, and PL/SQL.

The active steering application 208 may be configured to implement the functions, features, modules, processes, and methods of the ECU 126 described herein. In particular, the computer-executable instructions embodying the active steering application 208 may be configured, upon execution by the processor 202, to cause the processor 202 to implement the functions, features, modules, processes, and methods of the ECU 126 described herein. For instance, the active steering application 208 of the ECU 126 may be configured to monitor the operating condition of the PWC 100, such as based on operational data received from the navigation system 128 and/or the sensors 130. Responsive to the operational data indicating a user torque applied to the steering system 104, such as via the handle 116, the active steering application 208 may be configured to determine an additional torque to apply to the steering system 104 based on the operational data, and to operate the EAD 124 to apply the torque to the steering system 104. As described in more detail below, application of the additional torque to the steering system 104 may function to provide an active damper, self-centering feature, and other enhanced steering functions to the driver.

The non-volatile storage 206 may also include data supporting the functions, features, modules, processes, and methods of the ECU 126 described herein. The software of the ECU 26, such as the active steering application 208, may be configured to access this data during execution to determine how to provide various forms of enhanced steering control. For instance, the non-volatile storage 206 of the ECU 126 may include steering control data 212. As described in more detail below, the steering control data 212 may define one or more lookup tables that associate PWC operational conditions, such as indicated by the data generated by the navigation system 128 and/or sensors 130, with a torque to apply to the steering system 104.

The ECU 126 may be operatively coupled to one or more external resources 214 via the I/O interface 207. The I/O interface 207 may include one or more wireless interfaces such as Wi-Fi and Bluetooth, and may include one or more wired interfaces such as Ethernet and CAN. The external resources 214 may include one or more other components of the PWC 100. For example, the external resources 214 may include the EAD 124, the GPS module 134, the INS module 136, the sensors 130, and the HMI 132.

Figure 3:
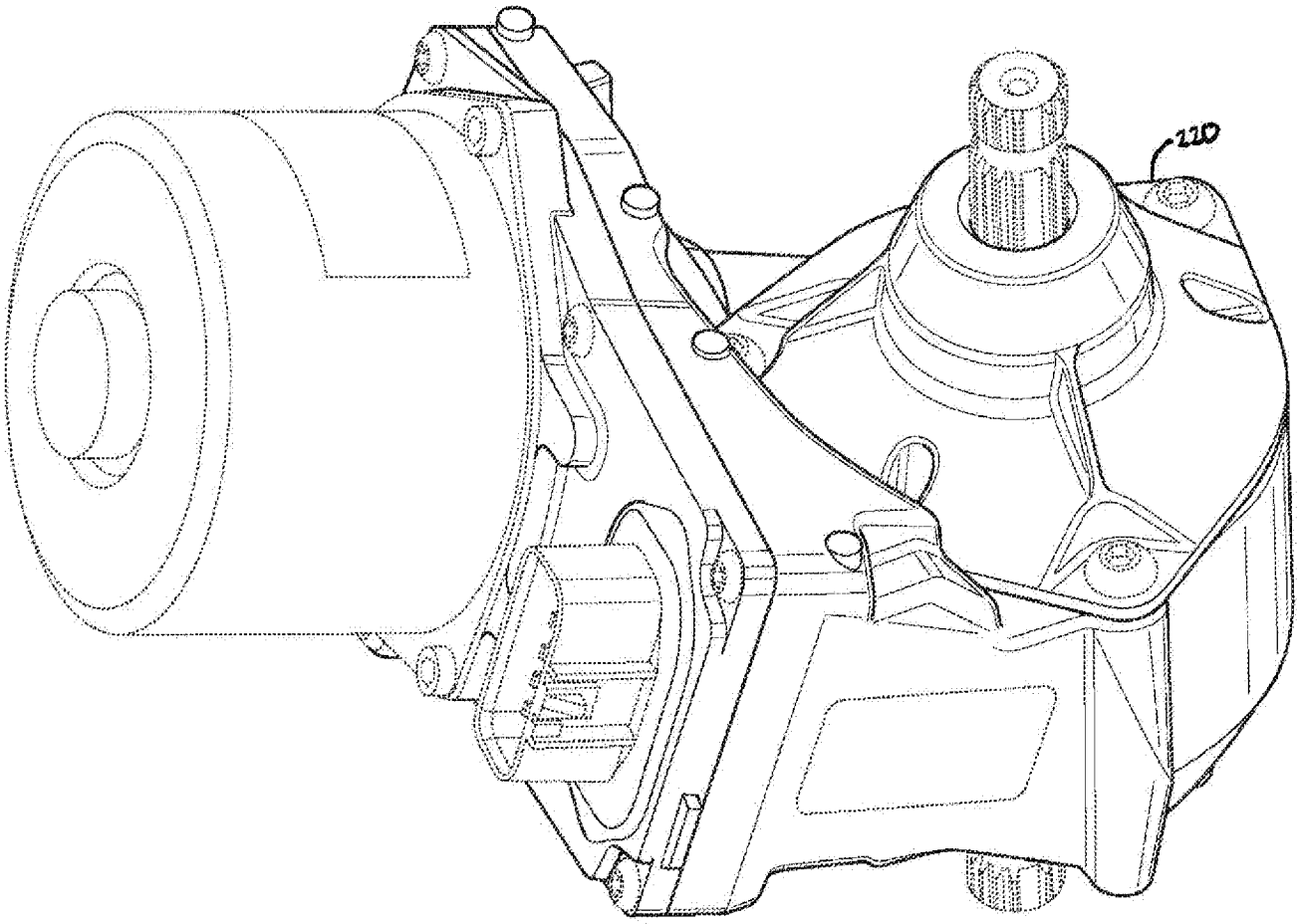
FIG. 3 is a perspective view of an exemplary driving control device that may be coupled to the steering system of a personal watercraft to provide enhanced steering control for the personal watercraft.

While an exemplary PWC 100 is illustrated in FIGS. 1 and 2, the example is not intended to be limiting. Indeed, the PWC 100 may have more or fewer components, and alternative components and/or implementations may be used. For instance, two or more of the above-described components of the driving control system 102, such as two or more of the EAD 124, ECU 126, sensors 130, or navigation system 128, may be combined into a signal unit or device adapted to be secured to the steering column 118 of the steering system 104. As an example, FIG. 3 illustrates a driving control device 220 adapted to be secured to the steering column 118 of the steering system 104. The driving control device 220 may include the components of the driving control system 102, such as the EAD 124, ECU 126, and one more of the sensors 130 (e.g., the torque sensor and steering angle sensor).

Figure 4:
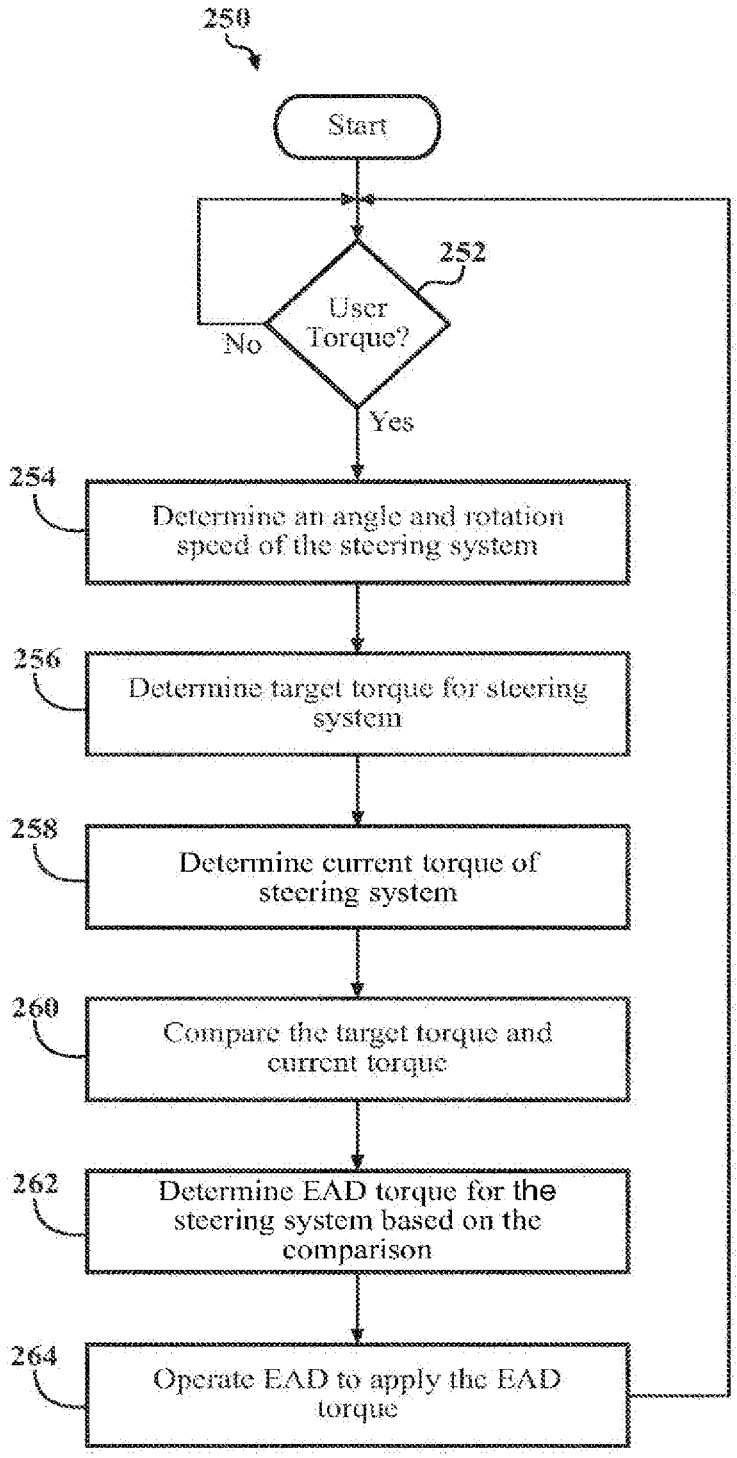
FIG. 4 is a flowchart of a method for implementing an active damper in a personal watercraft.
Figure 5:
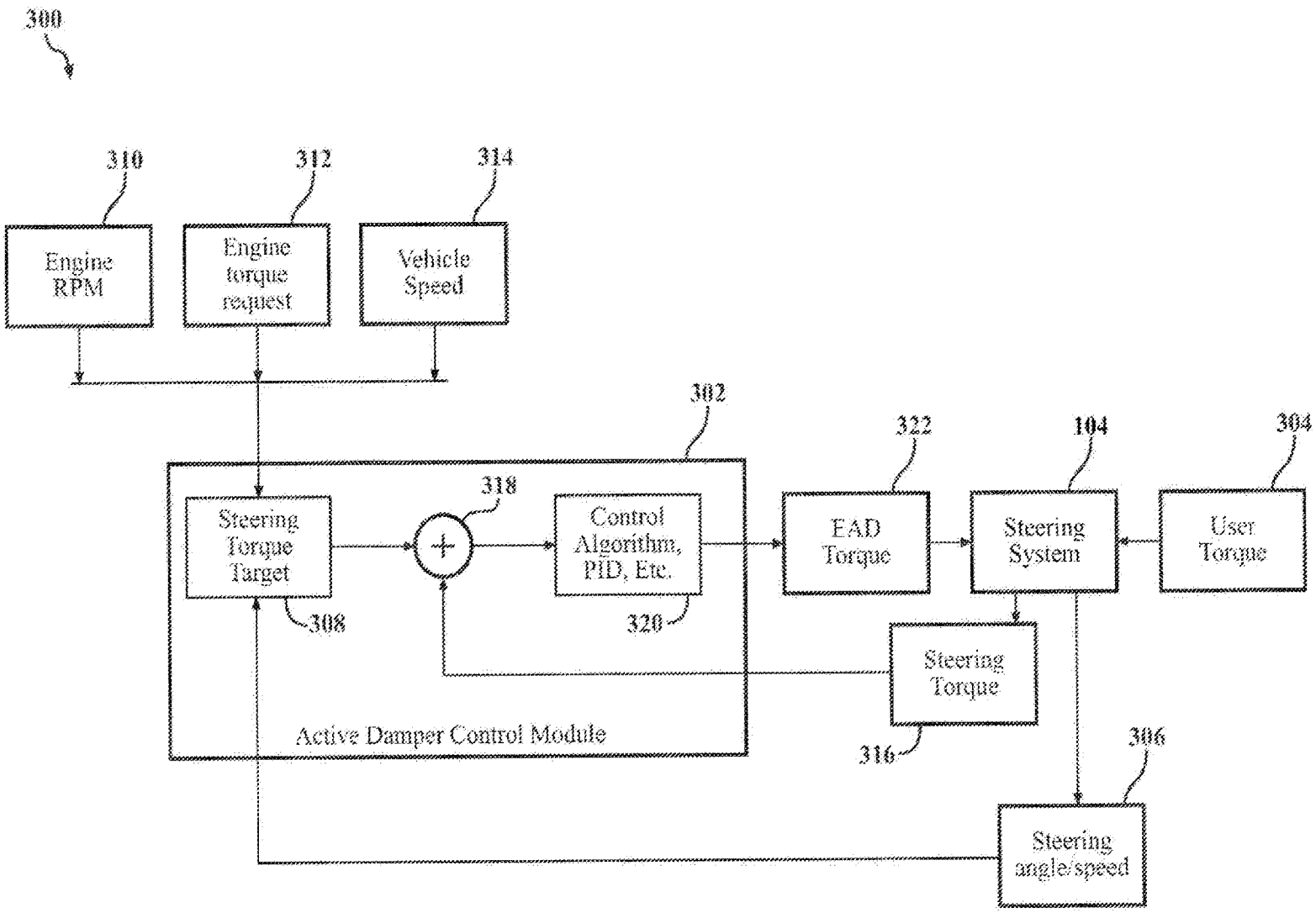
FIG. 5 is a diagram of a processing architecture for implementing an active damper in a personal watercraft.

FIG. 4 illustrates a method 250 for providing enhanced steering control for the PWC 100 in the form of an active damper, and FIG. 5 illustrates a processing architecture 300 for implementing the active damper. The active damper may function to increase feedback felt by a driver when turning the PWC 100 via the handle 116. Such feedback may inspire the driver of the PWC 100 with greater confidence and steering control, leading to avoidance of potentially dangerous maneuvers, such as sharp and excessive steering operations as described above. The ECU 126 may be configured to implement the method 250 and processing architecture 300, such as upon execution of the active steering application 208. For instance, the processing architecture 300 may include an active damper control module 302, which may be implemented by the ECU 126 upon execution of the computer-executable instructions embodying the active steering application 208. The active damper control module 302 may then be configured to perform the method 250. The following description of implementation of the active damper thus includes reference to both FIGS. 4 and 5.

In block 252, a determination may be made of whether user torque 304 is being applied to the steering system 104, such as via rotation of the handle 116. As described above, the sensors 130 may include a steering angle sensor and a steering torque sensor. These sensors may be integrated with EAD 124 or may be external of the EAD 124 and otherwise mounted to the steering system 104 of the PWC 100 (e.g., mounted to the handle 116, steering column 118, or nozzle 112). Responsive to an input of user torque 304 to the handle 116 to perform a turn, the steering angle sensor may generate operational data indicating the changing angle of the steering system 104, or more particularly of the handle 116, and the steering torque sensor may generate operational data indicating the torque on the steering system 104. Responsive to the steering angle sensor generating operational data indicating that the handle 116 is being rotated, such as to a degree greater than a predefined threshold and/or at a speed greater than a predefined threshold, and/or to the steering torque sensor generating operational data indicating that the steering system 104 has a torque greater than a predefined threshold, the ECU 126 may be configured to determine that user torque 304 is being applied to the steering system 104.

In block 254, responsive to application of user torque 304 to the steering system 104, an angle and speed of the steering system 104, such as an angle and speed of rotation of the handle 116, or angle and speed of movement of the nozzle 112, may be determined. In particular, the ECU 126 may be configured, such as via implementation of the active damper control module 302, to determine steering angle/speed data 306 indicating the angle and speed of the steering system 104 based on the operational data generated by the steering angle sensor. The operational data generated by the steering angle sensor may indicate an angle of the steering system 104, or more particularly of the handle 116. The operational data generated by the steering angle sensor may also indicate a speed of rotation of the handle 116 by indicating the changing angle of the handle 116 over time.

In block 256, a target torque for the steering system 104 may be determined, such as based on the operational data generated by the sensors 130 and/or navigation system 128 of the PWC 100. In particular, the active damper control module 302 may receive the steering angle/speed data 306 determined based on the operational data generated from the steering angle sensor. The active damper control module 302 may also receive additional operational data from the sensors 130 and/or navigation system 128, such as engine RPM data 310 indicating an RPM value of the engine 108, engine torque request data 312 indicating an engine torque request value corresponding to the extent of user activation of the throttle 114, and vehicle speed data 314 indicating the speed of the PWC 100. The active damper control module 302 may be configured to determine target torque data 308 based on the angle and speed of the steering system 104 indicated in the steering angle/speed data 306, and/or based on one or more of the values determined from the additional data described above. The target torque data 308 may indicate an amount of torque desired to be present on the steering system 104 during a turn to simulate a steering feedback-based driving feel to the user. In other words, the target torque data 308 may indicate an amount of torque that should exist on the steering system 104 so that the driver feels a resistive force when making a turn.

The active damper control module 302 may be configured to determine the target torque data 308 based on the steering control data 212. The steering control data 212 of the ECU 126 may include a lookup table that associates one or more operational parameters (e.g., engine RPM value, engine torque request value, vehicle speed value, steering angle, and/or steering speed) with a target torque for the steering system 104, which may then be indicated by the target torque data 308. Alternatively, the active damper control module 302 may be configured to determine the target torque data 308 by applying one or more of these data items to a formula, which may likewise be stored in the ECU 126.

In block 258, the current torque on the steering system 104 may be determined. In particular, the ECU 126 may be configured to determine steering torque data 316 indicating the current torque on the steering system 104 based on operational data generated by the sensors 130, such as the torque sensor.

In block 260, the target torque and the current torque on the steering system 104 may be compared to determine an error therebetween. Specifically, the active damper control module 302 may be configured to perform a comparison 318 between the target torque data 308 and the steering torque data 316 to calculate an error between the current torque on the steering system 104 and the target torque for the steering system 104. The active damper control module 302 may be configured to apply the resulting error to a control algorithm 320.

In block 262, an EAD torque 322 to apply to the steering system 104 may be determined based on the comparison. Specifically, the control algorithm 320, which may include a proportional-integral-derivative (PID) algorithm, may be configured to determine an EAD torque 322 that reduces or eliminates the error. For instance, the control algorithm 320 may determine, as the EAD torque 322, a resistive torque that has a magnitude equal to the error and is in a direction that is opposite the rotation of the handle 116.

In block 264, the EAD 124 may be operated to apply the EAD torque 322 to the steering system 104. For instance, the ECU 126 may be configured to generate a command signal for the EAD 124 that, upon receipt by the EAD 124, causes the EAD 124 to apply the EAD torque 322 onto the steering system 104, such as via the steering column 118. More particularly, the steering control data 212 may define a lookup table associating each of various electrical current levels with a torque level applied to the steering system 104, or more particularly to the steering column 118, by the EAD 124 responsive to application of the electrical current level to the motor 125. The ECU 126 may thus be configured to cause an electrical current level associated with the EAD torque 322 in the steering control data 212 to be supplied to the motor 125.

As previously described, the EAD torque 322 may be a resistive torque that is applied in a direction opposite the rotation of the handle 116. The applied torque may thus make the handle 116 more difficult to turn and may thereby provide feedback to the driver. The amount of feedback may correspond to current operational parameters of the PWC 100, such as one or more of the angle the steering system 104, which may be represented by the angle of the handle 116, the speed of the steering system 104, which may be represented by the rotation speed of the handle 116, the engine RPM value, the engine torque request value, and the speed of the PWC 100.

In some examples, rather than determining and comparing the target torque data 308 with the steering torque data 316, the active damper control module 302 may be configured to determine the EAD torque 322 based on operational data consisting only of the angle and speed of rotation of the steering system 104 (e.g., the steering angle/speed data 306). In other words, determining steering torque target data 308 and the comparison 318 may be omitted. In this case, the steering control data 212 may include a lookup table that associates each of various angle and speed combinations with a value of the EAD torque 322, or more particularly with an electrical current level to apply to the motor 125 of the EAD 124 to cause the EAD 124 to apply that value for the EAD torque 322. Accordingly, the active damper control module 302 may be configured to determine the EAD torque 322, or more particularly the electrical current level for causing the EAD 124 to provide the EAD torque 322, by querying the steering control data 212 based only on the angle and speed of rotation of the steering system 104, thus reducing processing time for implementation the active damper.

As illustrated in both FIGS. 4 and 5, the ECU 126 may be configured to implement a feedback loop that adjusts the EAD torque 322 applied to the steering system 104 by the EAD 124 to provide a driver with appropriate steering feedback during various parts of a turn. Specifically, the ECU 126 may be configured to adjust the applied EAD torque 322 based at least on updates to the steering angle/speed data 306 over time. For instance, referring to FIG. 4, the method 250 may loop back to monitoring for user torque on the steering system 104, determining an angle and speed of the steering system 104 caused by the user torque, and so on. Referring to FIG. 5, the processing architecture 300 may include a loop that, in each iteration, determines updated steering angle/speed data 306, and/or updated target torque data 308 and steering torque data 316, and determines an updated EAD torque 322 based thereon.

Figure 6:
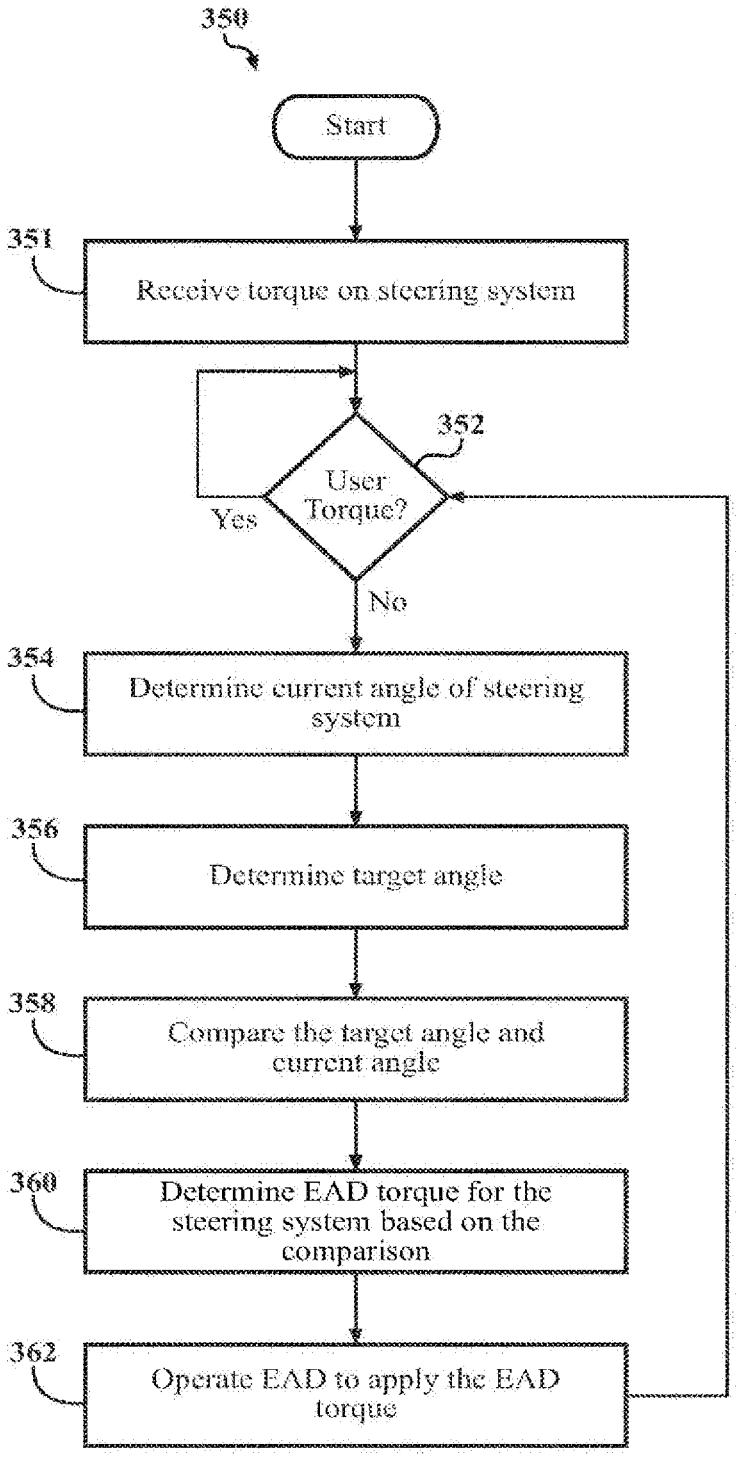
FIG. 6 is a flowchart of a method for implementing a self-centering system in a personal watercraft.
Figure 7:
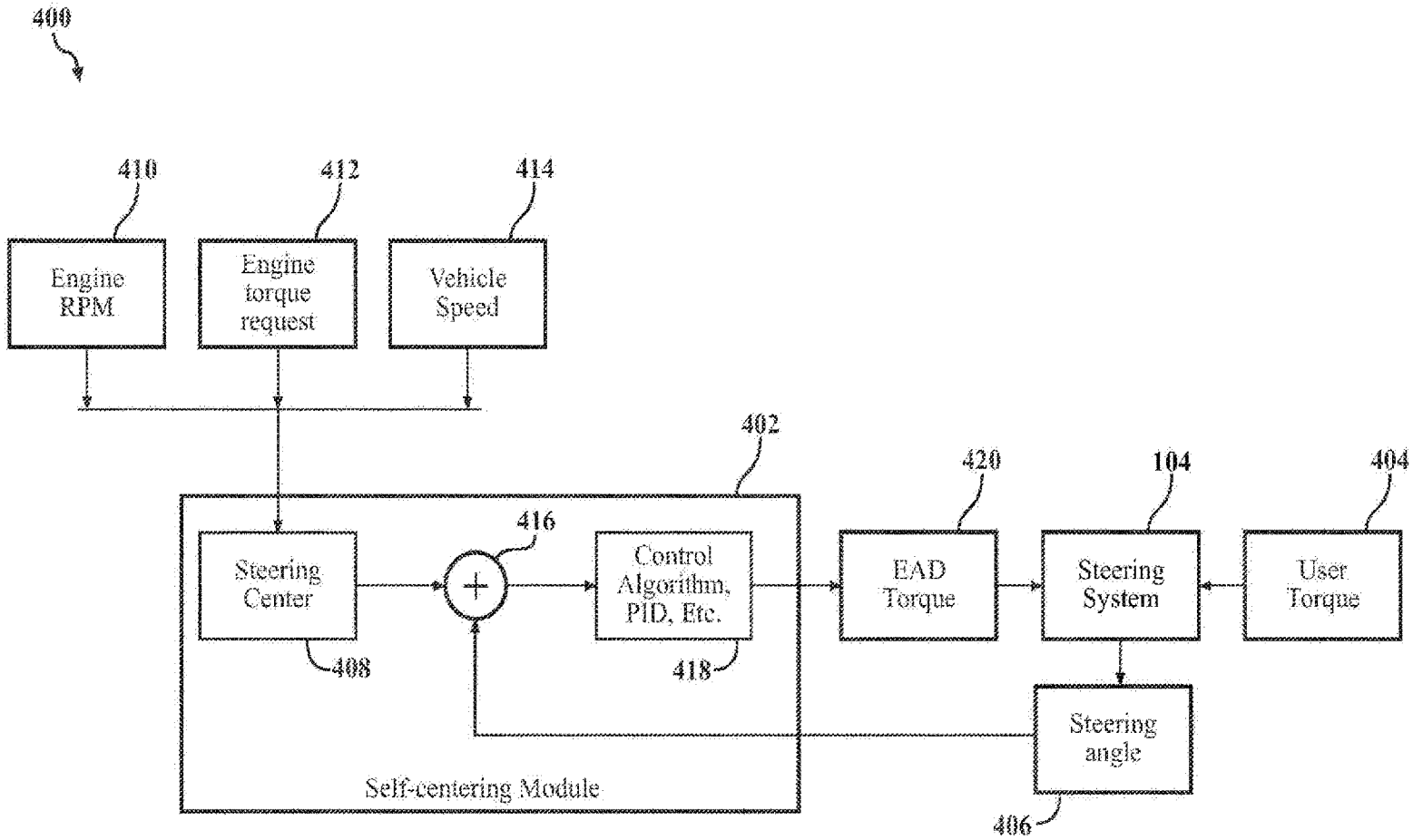
FIG. 7 is a diagram of a processing architecture for implementing a self-centering system in a personal watercraft.

FIG. 6 illustrates a method 350 for providing enhanced steering control in the form of a self-centering steering system, and FIG. 7 illustrates a processing architecture 400 for implementing the self-centering steering system. The steering dynamics of a typical PWC may make control of the PWC difficult at low vessel speeds relative to the water and/or in non-calm water conditions (e.g., wind, current, waves, swell). Specifically, because little or no resistive mechanical load is placed on the steering system of the typical PWC when the steering system, or more particularly the handle, is turned to a given angle, the steering system may stay at that angle, or may unreliably return to center at very low speed. The method 350 and processing architecture 400 may be configured to provide self-centering characteristics similar to those of an automobile by determining a centering torque that, when applied to the steering system 104, causes the steering system 104 to automatically self-center the steering system 104 absent sufficient user torque, thereby reducing course wandering at low vehicle speeds and making driving the PWC 100 more intuitive.

The ECU 126 may be configured to implement the method 350 and the processing architecture 400, such as upon execution of the active steering application 208. For instance, the processing architecture 400 may include a self-centering module 402, which may be implemented by the ECU 126 upon execution of the computer-executable instructions embodying the active steering application 208. The self-centering module 402 may then be configured to perform the method 350. The following description of implementation of the self-centering system thus includes reference to both FIGS. 6 and 7.

In block 351 of the method 350, torque may be received by the steering system 104 that causes the steering system 104 to become off-center. The applied torque may be user torque 404 applied by rotating the handle 116. Alternatively, the applied torque may be caused by an environmental factor of the PWC 100, such as a wave or wind interacting with the PWC 100.

In block 352, a determination may be made of whether a user is providing torque to the steering system 104, such as via rotation of the handle 116, to turn the PWC 100. In this case, the self-centering functionality may not be desired, and the active damper described above may be implemented. The ECU 126 may be configured to determine whether the user is providing torque to turn the PWC 100 based on operational data generated by the steering angle sensor and the torque sensor. Specifically, responsive to the steering angle sensor generating operational data indicating that the handle 116 is being rotated, such as to a degree greater than a predefined threshold and/or at a speed greater than a predefined threshold, and/or to the steering torque sensor generating operational data indicating that the steering system 104 has a torque greater than a predefined threshold, the ECU 126 may be configured to determine that a user is providing torque to turn the PWC 100 ("Yes" branch of block 352). Otherwise, the ECU 126 may be configured to determine that the user is not trying to turn the PWC 100 ("No" branch of block 352).

In block 354, a current angle of the steering system 104 may be determined. The steering angle sensor of the sensors 130 may generate operational data indicative of the angle of the steering system 104, or more particularly of the handle 116, resulting from the torque in block 351. The ECU 126 may thus be configured to generate steering angle data 406 indicating the current steering angle of the steering system 104 based on the data generated by the steering angle sensor.

In block 356, a target steering angle for returning the steering system 104 to a center position may be determined, such as based on the operational data generated by the sensors 130. The target steering angle may represent an angle for the steering system 104, or more particularly for the handle 116, that, given the operational data generated by the sensors 103, results in the jet stream being parallel and/or collinear with the longitudinal axis of the PWC 100. When the PWC 100 is new and the steering system 104 is properly calibrated, the target steering angle may be zero. Over time, however, the components of the steering system 104 may become misaligned and/or stretched such that zero no longer coincides with the jet stream being parallel and/or collinear with the longitudinal axis of the PWC 100. In this case, the self-centering module 402 may be configured to determine the non-zero steering center based on the operational data generated by the sensors 130, such as the engine RPM data 410, engine torque request data 412, and/or the vehicle speed data 414. In particular, during operation of the PWC 100, the self-centering module 402 may be configured to log correlations between the angle of the handle 116 and the jet stream, such as via a sensor 130 configured to measure an angle of the nozzle 112, during different operating conditions. The self-centering module 402 may then be configured to generate steering center data 408 indicating the target steering angle based on the received operational data and the log.

In block 358, the current steering angle and the target steering angle may be compared to determine an error therebetween. Specifically, the self-centering module 402 may be configured to perform a comparison 416 between the steering angle data 406 and the steering center data 408 to determine the error. The self-centering module 402 may be configured to apply the resulting error to a control algorithm 418. In block 360, an EAD torque 420 for reducing or eliminating the error may be determined. In particular, the control algorithm 418, which may include a PID algorithm, may be configured to determine the EAD torque 420 that should be applied to the steering column 118 by the EAD 124 to reduce or eliminate the error, and thereby cause the steering system 104 to center when little or no torque is applied by the driver. Specifically, the steering control data 212 may include a lookup table that associates each of various angle errors with a value for the EAD torque 420, or more particularly with an electrical current level to apply to the motor 125 of the EAD 124 to cause the EAD 124 to apply that value for the EAD torque 420. The self-centering module 402 may thus be configured to query the steering control data 212 based on the angle error to determine the EAD torque 420.

In block 362, the EAD 124 may be operated to apply the EAD torque 420 to the steering system 104. For instance, the ECU 126 may be configured to generate a command signal for the EAD 124 that, upon receipt by the EAD 124, causes the EAD 124 to apply the EAD torque 420 onto the steering system 104, such as via the steering column 118. More particularly, the ECU 126 may be configured to cause an electrical current level to be supplied to the motor 125 that in turn causes the motor 125 to apply the EAD torque 420 to the steering system 104. The EAD torque 420 may cause the steering system 104 to return to a center position.

As illustrated in both FIGS. 6 and 7, the ECU 126 may be configured to implement a feedback loop that adjusts the centering torque applied to the steering system 104 by the EAD 124 to provide proper self-centering functionality. Specifically, the ECU 126 may be configured to adjust the applied centering torque based on updates to the current steering angle of the steering system 104 and/or to the target steering angle derived from the operational data over time. For instance, referring to FIG. 6, the method 350 may loop back to determining whether user torque is being applied to the steering system 104, and so on. Referring to FIG. 7, the processing architecture 400 may include a loop that, in each iteration, determines updated steering angle data 406 and/or steering center data 408, and determines updated EAD torque 420 based thereon.

As previously described, the PWC 100 may be steerable by activating the throttle 114 to form a jet stream, and thereafter rotating the handle 116 to angle the jet stream in a direction corresponding to the desired heading. Responsive to a rotation of the handle 116 by a user, the ECU 126 may be configured, such as via the active damper control module 302 and/or the self-centering module 402, to apply a resistive force onto the steering system 104 to provide a more intuitive and comfortable experience for the driver. When a collision of the PWC 100 is imminent, however, a driver may impulsively release the throttle 114, which may eliminate the jet stream steering forces and correspondingly render the handle 116 unable to affect a turn away from the collision. The ECU 126 may be configured to alert the driver to this lack of steering control when the throttle 114 is released by being configured to disable the EAD 124 from applying torque onto the steering system 104 responsive to a user throttle release event. Disabling the EAD 124 in this manner may remove all artificial resistive torque applied by the EAD 124 from the steering system 104, which may be perceived by the driver through an increased ease in rotating the handle 116 and may correspondingly remind the driver to reengage the throttle 114 to steer away from the collision.

Figure 8:
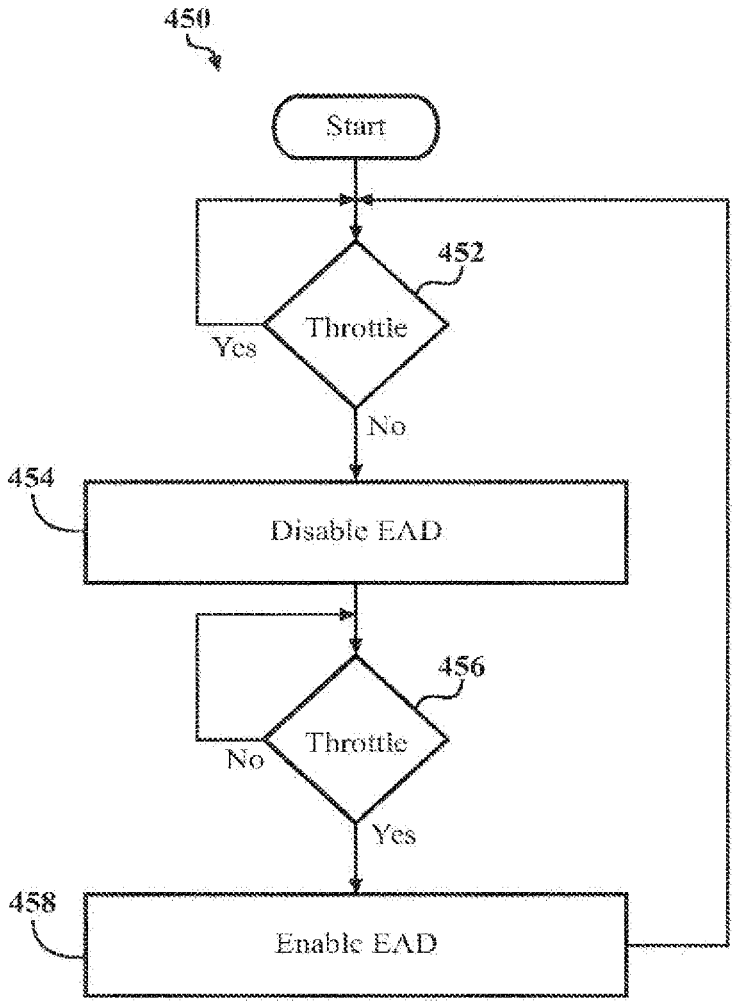
FIG. 8 is a flowchart of a method for alerting a driver of a personal watercraft regarding steering control.

FIG. 8 illustrates a method 450 for providing the lack of steering control warning described above. The ECU 126, such as via the active steering application 208, may be configured to implement the method 450.

In block 452, a determination may be made of whether the driver is actuating the throttle 114. As previously described, the sensors 130 may be configured to generate operational data indicating an extent to which the throttle 114 is being actuated by a driver. The ECU 126 may thus be configured to determine whether the throttle 114 is being actuated based on the operational data. Responsive to a throttle release event ("No" branch of block 452), in block 454, the EAD 124 may be disabled from providing any resistive torque onto the steering system 104. In other words, the ECU 126 may be configured to disable the active damper control module 302, the self-centering module 402, and any other enhanced steering control features described herein. In this way, the driver may feel little or no resistance when rotating the handle 116 in the absence of throttle, thereby avoiding the driver having a false sense of control. As a result, if a driver releases the throttle 114 while steering to avoid a collision, he or she will immediately sense a drop in the resistive torque applied to the steering system 104. This drop in resistive torque may help remind the driver to apply the throttle 114 to regain steering control of the PWC 100.

Responsive to the EAD 124 being disabled, in block 456, a determination may be made of whether the throttle 114 is reengaged. The ECU 126 may be configured to similarly make this determination based on the operational data generated by the sensors 130. Responsive to the throttle being reengaged ("Yes" branch of block 456), in block 458, the EAD 124 may be enabled to apply resistive torque onto the steering system 104. Specifically, the ECU 126 may be configured to enable the other enhanced steering control features described herein. The method 450 may then loop back to the determination of block 452.

The dynamics of the steering system of a typical PWC may enable the PWC to be easily affected by environmental elements, especially when the PWC is traveling at low speeds relative to the water and/or in non-calm water conditions. For example, when little or no throttle is being applied by a driver, a strong wave or current may cause the typical PWC to veer off course. The driving control system 102 may thus be configured to implement enhanced steering control in the form of an autopilot system that is configured to provide course corrections, such as when environmental conditions cause the PWC 100 to veer off course from a set heading or destination.

Figure 9:
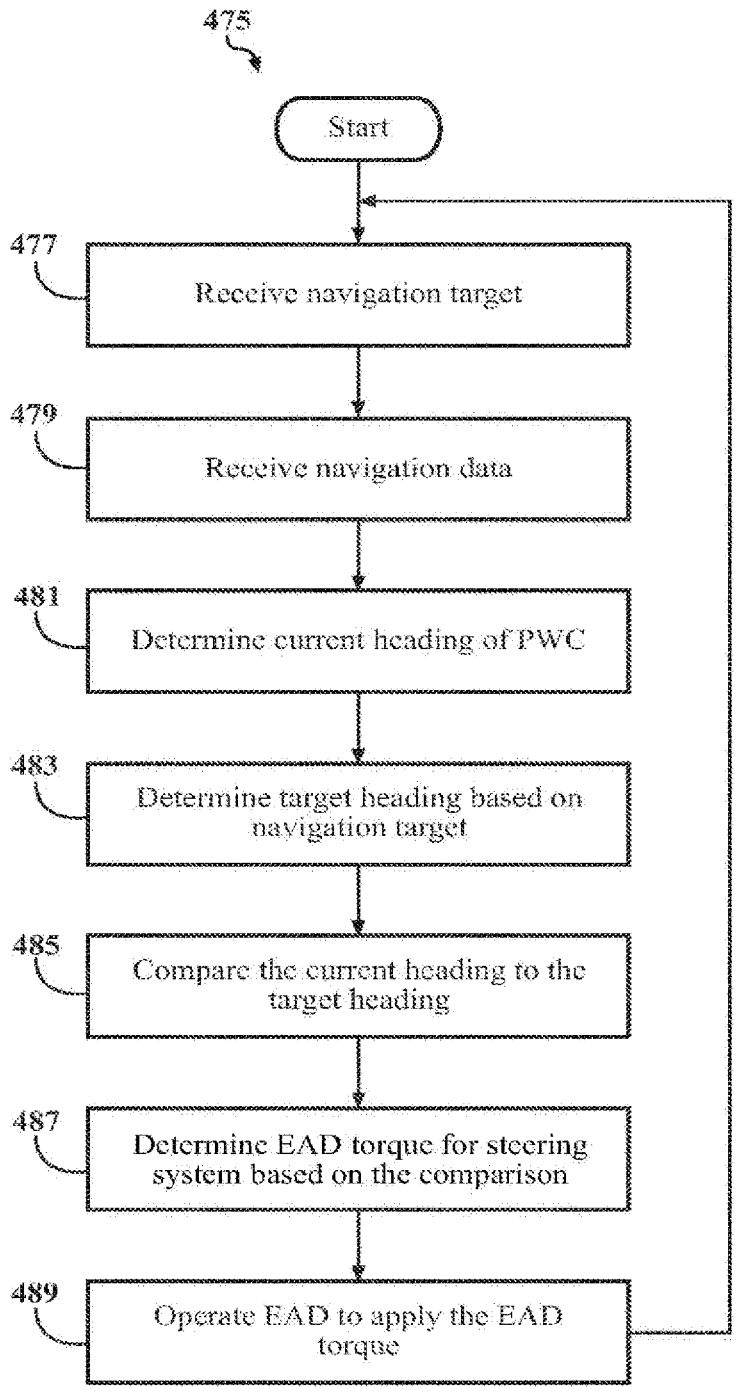
FIG. 9 is a flowchart of a method for implementing an autopilot system in a personal watercraft.
Figure 10:
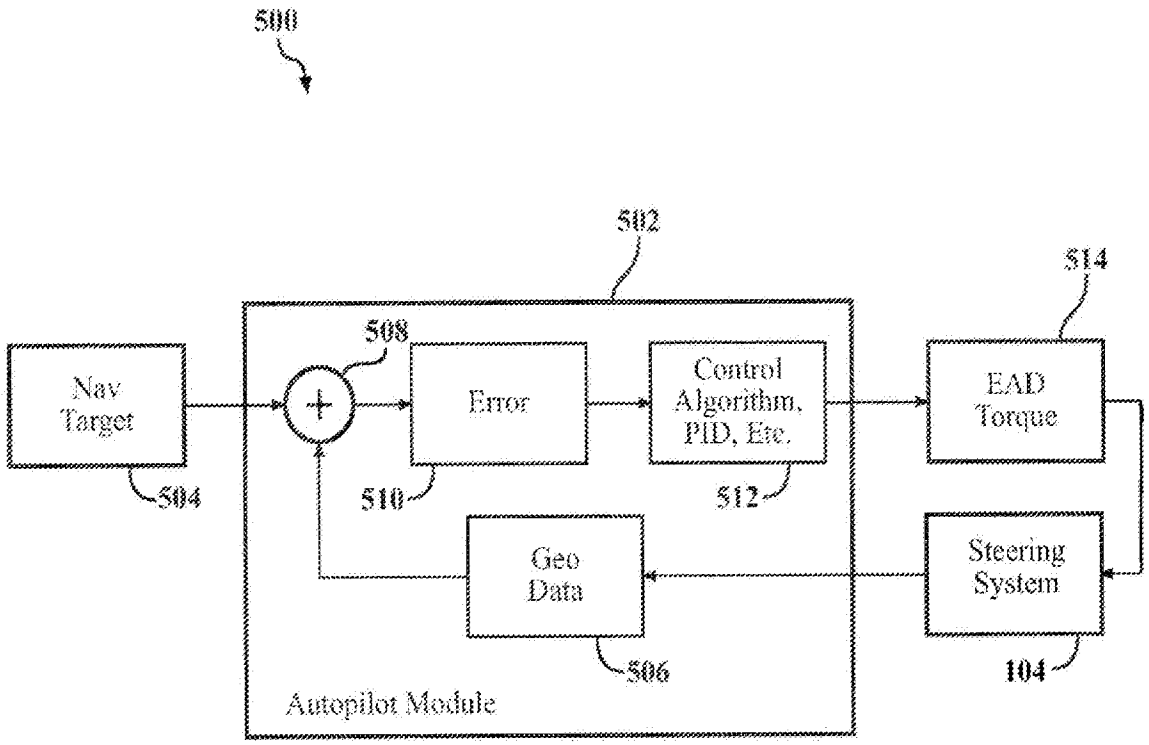
FIG. 10 is a diagram of a processing architecture for implementing an autopilot system in a personal watercraft.

FIG. 9 illustrates a method 475 for implementing an autopilot system, and FIG. 10 illustrates a processing architecture 500 for implementing the autopilot system. The method 475 and the processing architecture 500 may each include a control loop configured to continuously monitor a position and orientation of the PWC 100 relative to a navigation target, and to identify situations in which the PWC 100 veers off course. In such situations, the method 475 and processing architecture 500 may be configured to apply a corrective torque to the steering system 104 that causes the PWC 100 to move back on course.

The ECU 126 may be configured to implement the method 475 and the processing architecture 500, such as via execution of the active steering application 208. For instance, the processing architecture 500 may include an autopilot module 502, which may be implemented by the ECU 126 upon execution of the computer-executable instructions embodying the active steering application 208. The autopilot module 502 may then be configured to perform the method 475. The following description of implementation of the autopilot system thus includes reference to both FIGS. 9 and 10.

In block 477 of the method 475, a navigation target 504 may be received, such as by the autopilot module 502. The navigation target 504 may define a position (e.g., destination target) or heading lock set by a driver. Specifically, the driver may interact with the HMI 132 to set a position or heading lock, which may then be received by the autopilot module 502. As described in more detail below, the autopilot module 502 may be configured to determine a torque to apply the steering system 104 via the EAD 124 based on the navigation target. In block 479, geographic data 506 may be received, such as by the autopilot module 502, from the navigation system 128. The autopilot module 502 may then be configured to perform a comparison 508 based on the navigation target 504 and the geographic data 506 and identify an error 510 therebetween.

To this end, the autopilot module 502 may be configured to perform blocks 481 through blocks 485 of the method 475. In block 481, a current heading of the PWC 100 may be determined based on the geographic data 506. As previously described in reference to the navigation system 128, the geographic data 506 may indicate a current position and heading of the PWC 100. In block 483, a target heading for the PWC 100 may be determined based on the navigation target 504. In particular, if the navigation target 504 includes a heading lock, then the autopilot module 502 may be configured to set the target heading as the heading lock. If the navigation target 504 includes a position (e.g., destination) lock, then the autopilot module 502 may be configured to determine the target heading based on the location of the PWC 100 relative to the destination. Specifically, the autopilot module 502 may include map data, and may be configured to determine a target heading for the PWC 100 that leads the PWC 100 to the set destination based on the map data. In block 485, the current heading of the PWC 100 may be compared to the target heading of the PWC 100 to determine an error 510 therebetween. The error 510 may indicate if and how far the PWC 100 has veered off course from the navigation target.

In block 487, an EAD torque 514 to apply to the steering system 104 to course correct the PWC 100 may be determined based on the comparison. In particular, the autopilot module 502 may be configured to apply the determined error 510 to a control algorithm 512 implemented by the autopilot module 502, which may include a PID algorithm. The control algorithm 512 may be configured to calculate a correction that minimizes the error 510. Specifically, the control algorithm 512 may be configured to determine a target angle for the steering system 104 to adjust the PWC 100 from the current heading to the target heading, and thereby reduce the error 510, such as based on the steering control data 212, which may define a lookup table associating each of various errors 510 with a different target angle for the steering system 104. The control algorithm 512 may then be configured to determine an EAD torque 514 that indicates an amount and direction of torque to apply to the steering column 118 by the EAD 124 to reduce the error 510, and thereby put the PWC 100 back on course. The control algorithm 512 may be configured to determine the EAD torque 514 based on the steering control data 212, which may define a lookup table that associates each of various target angles of the steering system 104 with a value for the EAD torque 514, or more particularly with an electrical current level to apply to the motor 125 of the EAD 124 to cause the EAD 124 to apply that value for the EAD torque 420 to the steering system 104.

In block 489, the EAD 124 may be operated to apply the EAD torque 514 to the steering system 104. Specifically, responsive to generating the EAD torque 514, the autopilot module 502 may be configured to communicate a command signal to the EAD 124 that, upon receipt by the EAD 124, causes the EAD 124 to apply the EAD torque 514. More particularly, the ECU 126 may be configured to cause an electrical current level to be supplied to the motor 125 that in turn causes the motor 125 to apply the EAD torque 514 to the steering system 104. Application of the EAD torque 514 onto the steering system 104 by the EAD 124 may cause a course correcting turn of the PWC 100 in accordance with the navigation target 504.

As illustrated in the method 475 of FIG. 9 and the processing architecture 500 of FIG. 10, the ECU 126 may be configured to repeat performance of a control loop that adjusts the EAD torque 514 applied to the steering system 104 to provide course correction based on updated geographic data 506 of the PWC 100 and the navigation target 504. As a result, the method 475 and the processing architecture 500 may provide drivers with improved steering control by reducing their involvement in course correction and reducing steering overshoots, which can be a frequent consequence of the lack of resistive steering and of the low-resolution steering of a typical PWC. In some examples, the ECU 126 may be configured to deactivate the autopilot module 502, and thus deactivate the autopilot functionality, responsive to receiving a deactivation input from the driver via the HMI 132, and/or responsive to rotation of the handle 116 and/or an activation of the throttle 114 greater than a respective threshold, which may be detected by the ECU 126 based on the operational data generated by the sensors 130.

Referring to FIGS. 1 and 11-15, as the nozzle 112 pivots away from the longitudinal axis of the PWC 100 responsive to a rotation of the handle 116 to perform a turn, the jet stream formed by the nozzle 112 may cause a hull 550 of the PWC 100 to lean in towards the turn. The hull's 550 geometry, which may include ridges or other fixed control surfaces, may interact with the water on the inside the turn, and may be shaped to effect turning of the PWC 100 under the power of the jet stream. To further enhance the turning ability of the PWC 100, the steering system 104 of the PWC 100 may include control surfaces 552 positioned at opposed ends of an aft portion of the PWC 100 on each side of the nozzle 112. These control surfaces 552 may likewise be configured to interact with the water responsive to a rotation of the handle 116 to facilitate a turn. The control surfaces 552 may be shaped to affect a faster turn, thereby improving reactivity of the PWC 100 to steering input, especially at higher speeds.

Figure 11:
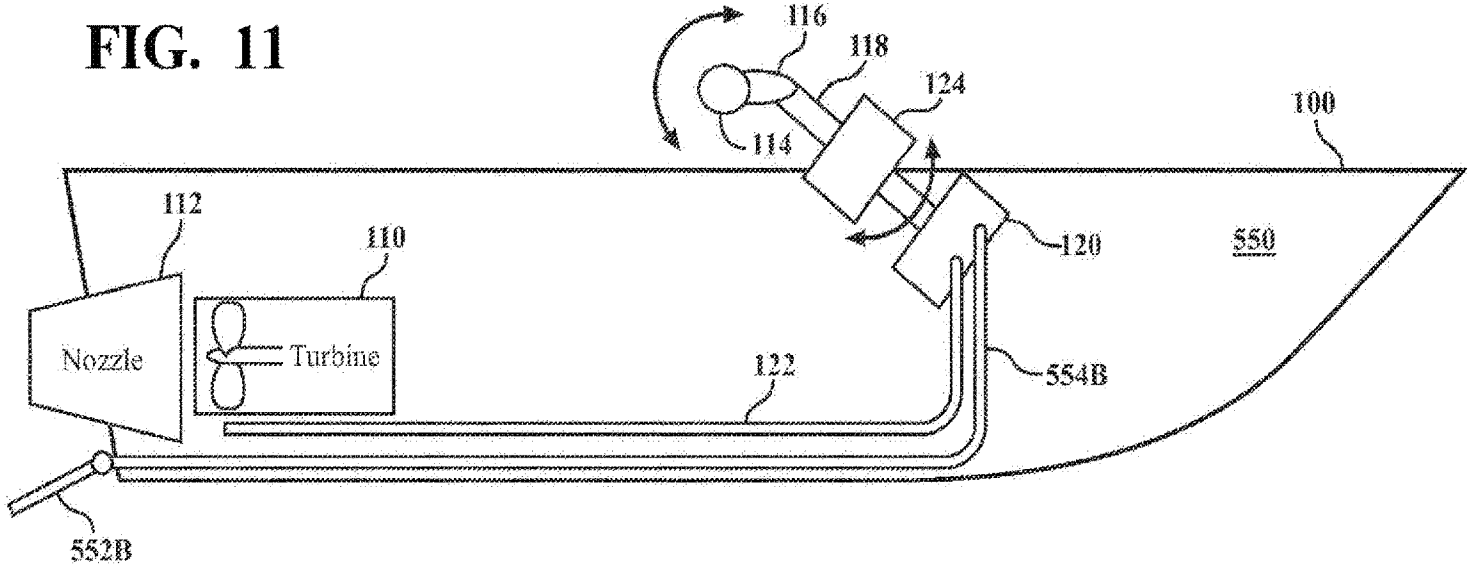
FIG. 11 is a schematic diagram illustrating a simplified side view of a personal watercraft.
Figure 12:
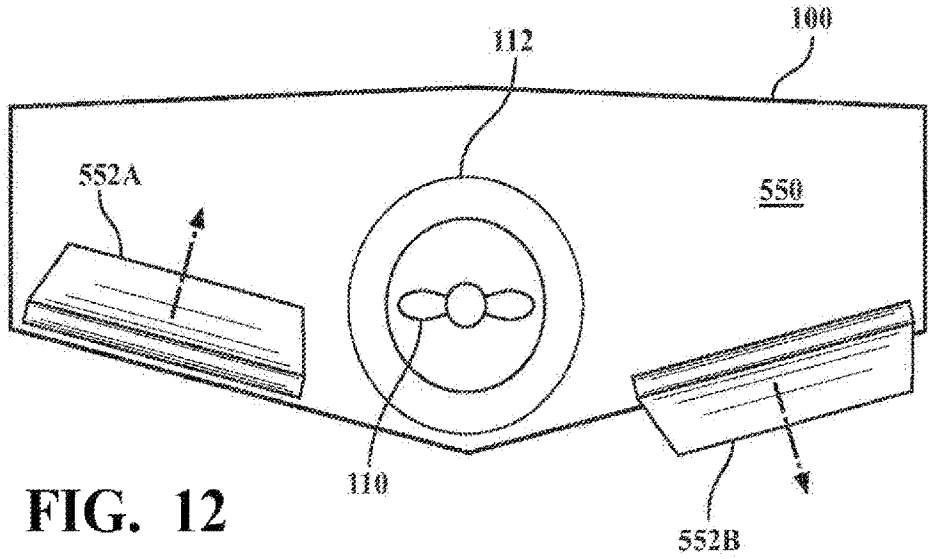
FIG. 12 is a schematic diagram illustrating a simplified rear view of a personal watercraft.

As shown in FIGS. 1 and 11, the control surfaces 552 may be mechanically coupled to the handle 116 via the steering column 118, gearbox 120, and supplemental push-pull cables 554. Responsive to a rotation of the handle 116 to affect a turn of the PWC 100, the gearbox 120 may be configured, such as based on the rotation of the steering column 118 caused by the rotation of the handle 116, to cause the control surface 552 on the inside of the turn to lower into the water, such as by applying a force on the supplemental push-pull cable 554 coupled to the control surface 552 on the inside of the turn. Responsive to the handle 116 returning to a center position, the gearbox 120 may be configured to cause the control surface 552 on the inside of the turn to raise from the water, such as by applying an opposite force on the supplemental push-pull cable 554 coupled to the control surface 552 on the inside of the turn.

For instance, responsive to a rotation of the handle 116 to the right from a center position, the gearbox 120 may be configured to apply a push force onto the supplemental push-pull cable 554B, which may responsively apply a push force onto a proximal end of the control surface 552B, and thereby pivot a distal end of the control surface 552B into the water. Similarly, responsive to a rotation of the handle 116 to the left from the center position, the gearbox 120 may be configured to apply a push force onto the supplemental push-pull cable 554A, which may responsively apply a push force onto a proximal end of the control surface 552A, and thereby pivot a distal end of the control surface 552A into the water. During high speeds, the control surfaces 552 may cause the PWC 100 to lean faster and sooner towards a turn, which improves the contact between the hull 550 and the water on inside of the turn and causes the PWC 100 to start turning sooner. Responsive to the handle 116 being returned to the center position from the right or left, the gearbox 120 may be configured to apply a pull force on the supplemental push-pull cable 554B or the supplemental push-pull cable 554A respectively, which may then apply a pull force to and correspondingly lift the control surface 552B or the control surface 552A respectively.

The operation of the control surfaces 552 via the supplemental push-pull cables 554 may increase resistive load on the steering system 104, or more particularly the steering column 118 and the handle 116, during a turn. To avoid driver fatigue resulting from this additional resistive load, responsive to a driver beginning a turn that causes a control surface 552 to be lowered into the water, the EAD 124 may be configured to apply torque to the steering column 118 in the same direction as the driver's torque applied via the handle 116. In this way, the EAD 124 may assist the driver in overcoming the resistive force caused by the control surfaces 552.

The control surfaces 552, which may have a fin-like structure, may also improve maneuverability of the PWC 100 in the absence of thrust being provided by an active jet stream. Specifically, while rotating the handle 116 in the absence of activation of the throttle 114 may cause the nozzle 112 to pivot relative to the longitude axis of the PWC 100, because no jet stream is being produced by the nozzle 112, the hull 550 may not lean into the water to effect the turn. Each of the control surfaces 552, however, may function as a rudder when inserted into the water. For example, the control surface 552A may be structured and angled to bias the PWC 100 left when lowered into the water, and the control surface 552B may be structured and angled to bias the PWC 100 right when lowered into the water. The control surfaces 552 may thus improve maneuverability of the PWC 100 by enabling the PWC 100 to be biased (or steered) left and right in the absence of an active jet stream.

Figure 13:
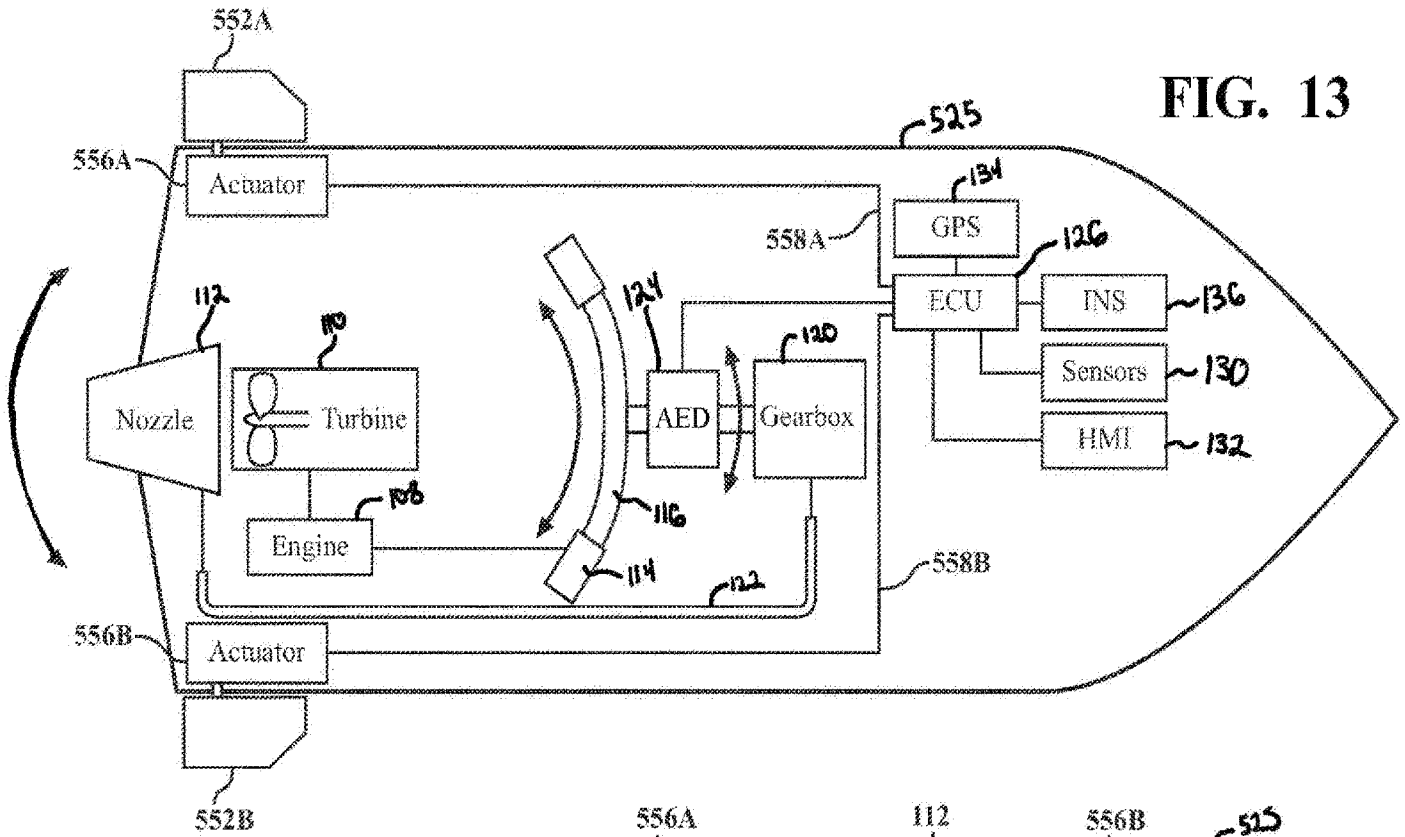
FIG. 13 is a schematic diagram illustrating a personal watercraft having control surfaces electrically coupled to the steering system of the personal watercraft.
Figure 14:
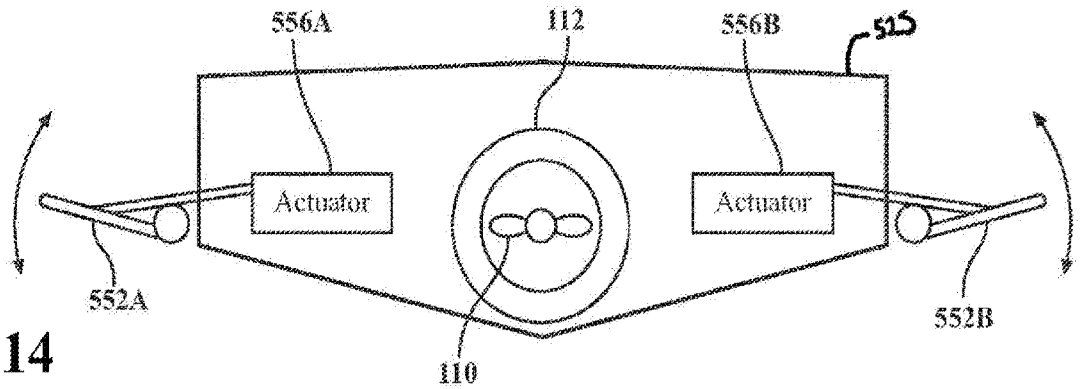
FIG. 14 is a schematic diagram illustrating a simplified rear view of the personal watercraft of FIG. 13.

Referring to FIGS. 13 and 14, rather than being mechanically coupled to the handle 116, the control surfaces 552 may be electrically coupled to the handle 116, such as via the ECU 126. Specifically, referring to FIGS. 13 and 14, each of the control surfaces 552 may be mechanically coupled to a respective actuator 556. Each actuator 556 may be electrically coupled to and configured to receive command signals from the ECU 126, such as wirelessly or via a respective electrical wire 558. Responsive to receiving a command signal from the ECU 126, each actuator 556 may be configured to lower or raise the respective control surface 552 coupled to the actuator 556 into and out of the water as appropriate.

As shown in the illustrated examples, the actuators 556 may be positioned in the aft of the PWC 100 near the control surfaces 552. Alternatively, the actuators 556 may be located elsewhere in and/or be integrated with another component of the PWC 100, such as the gearbox 120 or EAD 124, and may be mechanically coupled to the control surfaces 552 using the push-pull cables 554 as described above.

Figure 15:
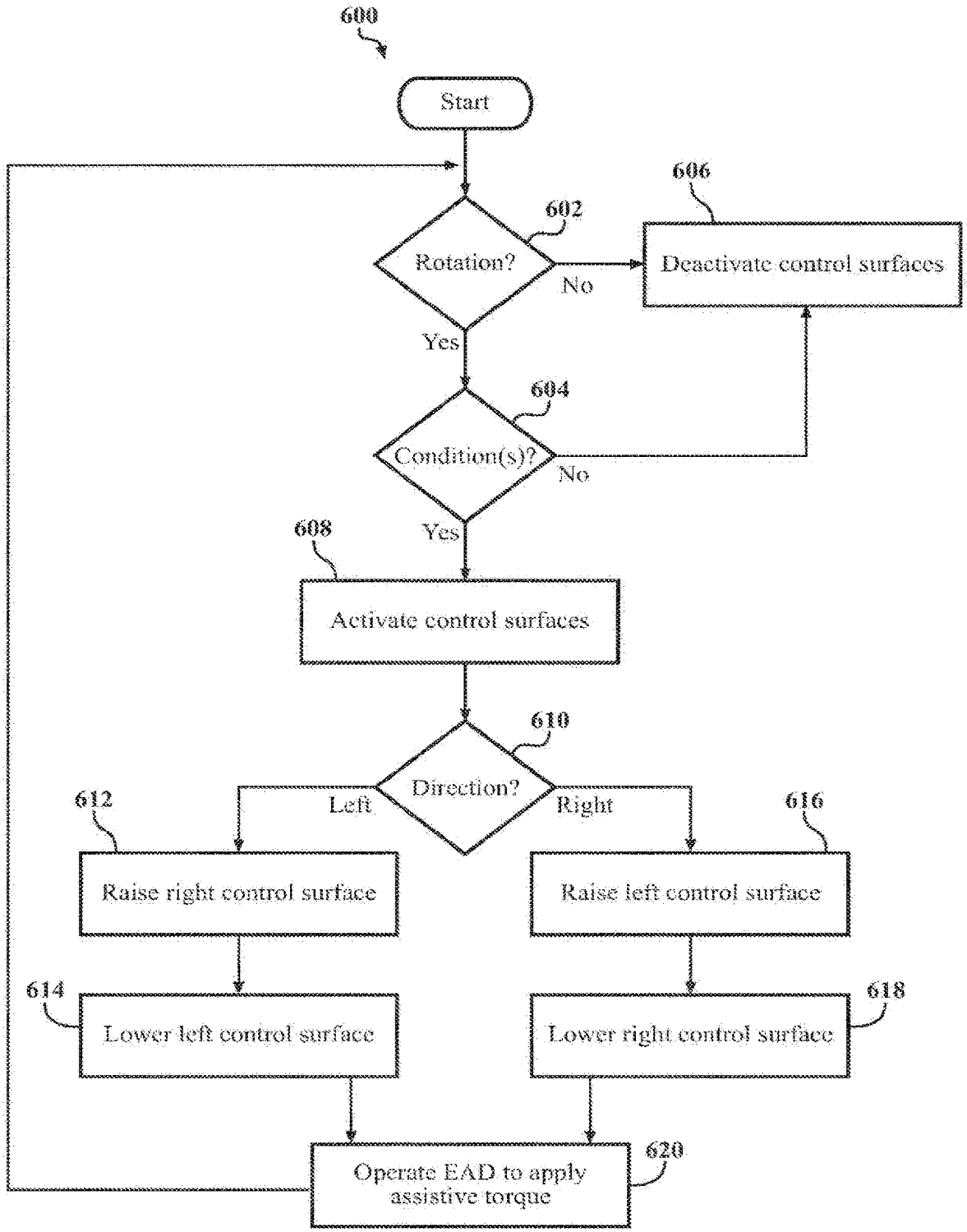
FIG. 15 is a flowchart of a method for operating control surfaces of a personal watercraft.

FIG. 15 illustrates a method 600 for actuating the control surfaces 552 to enhance steering of the PWC 100, as described above. The ECU 126 may be configured to perform the method 600, such as via execution of the computer-executable instructions embodying the active steering application 208.

In block 602, a determination may be made of whether the handle 116 has been rotated to perform a turn. For example, the ECU 126 may be configured to monitor for a rotation of the handle 116, such as based on operational data received from the sensors 130 indicating a rotation of the handle 116 (e.g., data generated by a steering angle sensor).

Responsive to identifying a rotation ("Yes" branch of block 602), in block 604, a determination may made of whether one or more conditions exist to support actuation of the control surfaces 552. The ECU 126 may be configured to identify whether these one or more conditions exist from the operational data generated by the sensors 130. For instance, the ECU 126 may be configured to determine whether the speed of the PWC 100 is greater than a threshold speed based on the operational data, which may increase the effectiveness of the control surfaces 552. In addition, or alternatively, the ECU 126 may be configured to determine whether the extent of the driver's actuation of the throttle 114 is greater than or equal to a threshold throttle level based on the operational data.

Responsive to determining that the one or more conditions do not exist ("No" branch of block 604), in block 606, actuation of the control surfaces 552 may be deactivated. For instance, when the coupling between the handle 116 and the control surfaces 552 is electrical, the ECU 126 may be configured to raise the control surfaces 552 (if lowered) via control signals to the actuators 556, and to prevent actuation of the control surfaces 552 by not transmitting command signals to the actuators 556 coupled to the control surfaces 552. When the coupling between the handle 116 and control surfaces 552 is purely mechanical, the ECU 126 may similarly be configured to raise the control surfaces 552 (if lowered) by applying a force, such as a pull force, onto the supplemental push-pull cables 554, and to prevent actuation of the control surfaces 552 by disconnecting the mechanical coupling. For instance, the gearbox 120 may include at least one motor that is configured, based on command signals received from the ECU 126 to effect raising the control surfaces 552 (if lowered) via interaction with the supplemental push-pull cables 554, and to mechanically disengage the steering column 118 from the supplemental push-pull cables 554. Hence, responsive to determining that the one or more conditions do not presently exist ("No" branch of block 604), in block 606, the ECU 126 may be configured to transmit a signal to the one or more motors that causes the motor to raise the control surfaces 552 and mechanically disengage the steering column 118 from the supplemental push-pull cables 554.

Responsive to determining that the one or more conditions do exist ("Yes" branch of block 604), in block 608, the control surfaces 552 may be activated. For instance, responsive to determining that the one or more conditions do presently exist, the ECU 126 may be configured to permit the transmission of control signals to the actuators 556 (if the control surfaces 552 are electrically coupled to the handle 116), or may be configured to transmit a signal to the mechanical coupling motor that causes the motor to mechanically couple the control surfaces 552 to the handle 116 (if the control surfaces 552 are configured to be mechanically coupled to the handle 116).

In block 610, a determination may be made of the direction of the rotation of the handle 116. For instance, the ECU 126 may be configured to determine whether the handle 116 is rotated left or right based on the angle of the handle 116 indicated by the operational data generated by the steering angle sensor of the PWC 100. Responsive to determining that the handle 116 is rotated left ("Left" branch of block 610), in block 612, the right control surface 552B may be raised (if not already raised), and in block 614, the left control surface 552A may be lowered (if not already lowered). Alternatively, responsive to determining that the handle 116 is rotated right ("right" branch of block 610), in block 616, the left control surface 552A may be raised (if not already raised), and in block 618, the right control surface 552B may be lowered (if not already lowered).

Thus, the PWC 100, or more particularly, the ECU 126, may be configured to lower the control surface 552A into water responsive to a rotation of the handle 116 in one direction and to a determination that one or more conditions exists, such as the speed of the PWC 100 being greater than a predefined threshold speed. The ECU 126 may similarly be configured to lower the control surface 552B into the water responsive to a rotation of the handle 116 in another direction opposite the one direction and to a determination that the one or more conditions exist. In alternative examples, block 604 may be omitted such that the ECU 126 is configured to lower and raise the control surfaces 552 responsive to rotation of the handle 116 alone. In addition, if the control surfaces 552 are mechanically coupled to the handle 116, the determination of block 610 may be performed by the gearbox 120 rather than the ECU 126 by virtue of the gearbox 120 being configured to mechanically translate left and right rotations of the handle 116 to forces that raise and lower the control surfaces 552 appropriately as described above.

When the control surfaces 552 are mechanically coupled to the handle 116 via the supplemental push-pull cables 554, lowering any one of the control surfaces 552 may increase the resistive load on the steering column 118 and the handle 116 during a turn. Thus, in block 620, the EAD 124 may be operated to apply assistive torque to the steering system 104, or more particularly to the steering column 118, to prevent driver fatigue resulting from this additional resistive load. Specifically, the ECU 126 may be configured to operate the EAD 124 to apply torque to the steering system 104 in a direction corresponding to the rotation of the handle 116. In other words, the ECU 126 may be configured to apply a torque to the steering system 104 in one direction responsive to a rotation of the handle 116 in the one direction, and to apply the torque to the steering system 104 in another direction opposite the one direction responsive to the rotation of the handle 116 in another direction. In this way, the EAD 124 may assist the driver in overcoming the resistive force caused by the control surfaces 552.

Providing an electrical rather than a mechanical coupling between the handle 116 and the control surfaces 152 may lessen the resistive load applied to the handle 116 by the control surfaces 152, which may avoid the need for the EAD 124 to apply torque to the steering column 118 that assists the driver in rotating the handle 116. However, installation of an actuator 556 on the PWC 100 for each control surface 552 may increase the weight of the PWC 100, which may adversely affect its overall speed and maneuverability capabilities.

In some examples, rather than the control surfaces 552 being automatically actuated on turns, the control surfaces 552 may be manually actuated by a user during turns, such as via user interaction with the HMI 132. For example, a driver may interact with the HMI 132 to input an actuation signal for one of the control surfaces 552 to the ECU 126, which in turn may transmit a command signal to the actuator 556 coupled to the control surface 552 to cause the control surface 552 to lower into and raise from the water.

Responsive to lowering one of the control surfaces 552 into the water to better effect a turn (block 614 or block 618), and possibly to operating the EAD 124 to apply assistive torque on the steering system 104 (block 620), the method 600 may return to block 602 to determine whether the handle 116 continues to be rotated, and so on. If the handle 116 is returned to center position ("No" branch of block 602), or one of the one or more conditions of block 604 ceases to exist ("No" branch of block 604), then in block 606, the control surfaces 552 may be deactivated as described above. The method 600 may then return to block 602.

PWCs including enhanced steering control are described herein. In one example, a PWC may include a driving control system coupled to a steering system of the PWC and configured to apply a torque to the steering system based on electrical signals received from an ECU. During operation of the PWC, the driving control system may be configured to implement enhanced steering functions, such as an active damper, regulated based on various operational parameters monitored by the ECU. The enhanced steering functions may install greater confidence in the driver, provide better steering control, and avoid potentially dangerous maneuvers.

In general, the routines executed to implement the embodiments of the method, whether implemented as part of an operating system or a specific application, component, program, object, module or sequence of instructions, or even a subset thereof, may be referred to herein as "computer program code," or simply "program code." Program code typically comprises computer readable instructions that are resident at various times in various memory and storage devices in a computer and that, when read and executed by one or more processors in a computer, cause that computer to perform the operations necessary to execute operations and/or elements embodying the various aspects of the embodiments of the present technology. Computer readable program instructions for carrying out operations of the embodiments of the technology may be, for example, assembly language or either source code or object code written in any combination of one or more programming languages.

Various program code described herein may be identified based upon the application within that it is implemented in specific embodiments of the invention. However, it should be appreciated that any particular program nomenclature that follows is used merely for convenience, and thus the invention should not be limited to use solely in any specific application identified and/or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a program product in a variety of different forms. In particular, the program code may be distributed using a computer readable storage medium having computer readable program instructions thereon for causing a processor to carry out aspects of the embodiments of the present technology.

Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. A computer readable storage medium should not be construed as transitory signals per se (e.g., radio waves or other propagating electromagnetic waves, electromagnetic waves propagating through a transmission media such as a waveguide, or electrical signals transmitted through a wire). Computer readable program instructions may be downloaded to a computer, another type of programmable data processing apparatus, or another device from a computer readable storage medium or to an external computer or external storage device via a network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions, acts, and/or operations specified in the flowcharts, sequence diagrams, and/or block diagrams. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, and/or operations specified in the flowcharts, sequence diagrams, and/or block diagrams.

In certain alternative embodiments, the functions, acts, and/or operations specified in the flowcharts, sequence diagrams, and/or block diagrams may be re-ordered, processed serially, and/or processed concurrently consistent with embodiments of the invention. Moreover, any of the flowcharts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While the present technology has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art.

What is claimed is:

1. A personal watercraft comprising:

a jet powered propulsion system;

a steering system coupled to the jet powered propulsion system and including a handle for adjusting an angle of the jet powered propulsion system relative a longitudinal axis of the personal watercraft; and a driving control system coupled to the steering system, the driving control system comprising:

an electrically actuated device coupled to the steering system for applying torque to the steering system;

at least one sensor positioned adjacent the steering system that generates operational data of the personal watercraft; and at least one controller coupled to the electrically actuated device and the at least one sensor, the at least one controller configured to:

determine whether user torque is being applied to the steering system to turn the personal watercraft; and responsive to determining that the user torque is not being applied to the steering system to turn the personal watercraft:

determine a steering angle of the steering system based on the operational data;

determine a target angle for the steering system for returning the steering system to a center position based on the operational data;

compare the steering angle to the target angle;

determine a centering torque for returning the steering system to the center position based on the comparison; and operate the electrically actuated device to apply the centering torque to the steering system for providing enhanced steering control of the personal watercraft, with the centering torque being applied only by the electrically actuated device.

2. The personal watercraft of claim 1, wherein the at least one controller is configured to determine the target angle for the steering system based on an engine RPM value, an engine torque request value, and a speed of the personal watercraft.

3. The personal watercraft of claim 1, wherein the operational data is determined based on an angle and a speed of the rotation of the handle.

4. The personal watercraft of claim 1, wherein the sensor that generates the operational data includes a steering angle sensor, the operational data including the steering angle.

5. The personal watercraft of claim 4, wherein the at least one controller is configured to implement a feedback loop that adjusts the centering torque applied to the steering system based on updates to the current steering angle and the target angle over time.

6. The personal watercraft of claim 1, wherein the steering system comprises a first control surface, and a second control surface, the first and second control surfaces positioned at opposed ends of an aft portion of the personal watercraft, and the at least one controller is configured to:

lower the first control surface into water responsive to a rotation of the handle in a first direction; and lower the second control surface into the water responsive to a rotation of the handle in a second direction.

7. The personal watercraft of claim 1, wherein the steering system comprises a first control surface, and a second control surface, the first and second control surfaces positioned at opposed ends of an aft portion of the personal watercraft, and the at least one controller is configured to:

lower at least one of the first and second control surfaces into the water, responsive to the controller determining the target angle for returning the steering system to the center position based on the operational data.

8. The personal watercraft of claim 1, wherein the steering system includes a first control surface and a second control surface, the first and second control surfaces positioned at opposed ends of an aft portion of the personal watercraft, and the at least one controller is configured to:

lower the first control surface into water responsive to a rotation of the handle in a first direction and to a determination that a speed of the personal watercraft is greater than a predefined speed; and lower the second control surface into the water responsive to a rotation of the handle in a second direction and to a determination that the speed of the personal watercraft is greater than the predefined speed.

9. The personal watercraft of claim 1, wherein the steering system includes a first control surface and a second control surface, the first and second control surfaces positioned at opposed ends of an aft portion of the personal watercraft, and the at least one controller is configured to:

lower at least one of the first and the second control surfaces into the water, responsive to the controller determining the target angle for returning the steering system to the center position based on the operational data and to a determination that the speed of the personal watercraft is greater than a predefined speed.

10. The personal watercraft of claim 9, wherein the first and second control surfaces are mechanically linked to the handle, and the at least one controller is configured to:

operate the electrically actuated device to apply the centering torque to the steering system responsive to determining that the user torque is not being applied to the steering system to turn the personal watercraft.

11. The personal watercraft of claim 1, further comprising a navigation system comprising a global positioning system (GPS) module and an inertial navigation system (INS) module; and wherein the at least one controller is configured to generate the geographic data by being configured to:

calibrate the INS module using the GPS module;

operate the INS module to generate the geographic data for a time period; and recalibrate the INS module using the GPS module responsive to expiration of the time period.

12. A driving control system for enhancing steering control of a jet powered personal watercraft including a jet powered propulsion system and a steering system coupled to the jet powered propulsion system and including a handle for adjusting an angle of the jet powered propulsion system relative to a longitudinal axis of the personal watercraft, the driving control system comprising:

an electrically actuated device adapted to be coupled to the steering system of the jet powered personal watercraft for applying torque to the steering system;

at least one sensor adapted to be positioned adjacent the steering system when the electrically actuated device is coupled to the steering system that generates operational data of the jet powered personal watercraft; and at least one controller coupled to the electrically actuated device and the at least one sensor, the at least one controller configured to:

determine whether user torque is being applied to the steering system to turn the personal watercraft; and responsive to determining that the user torque is not being applied to the steering system to turn the personal watercraft:

determine a steering angle of the steering system based on the operational data;

determine a target angle for the steering system for returning the steering system to a center position based on the operational data;

compare the steering angle to the target angle;

determine a centering torque for returning the steering system to the center position based on the comparison, and operate the electrically actuated device to apply the centering torque to the steering system for providing enhanced steering control of the personal watercraft, with the centering torque being applied only by the electrically actuated device.

13. The driving control system of claim 12, wherein the at least one controller is configured to determine the target angle for the steering system based on an engine RPM value, an engine torque request value, and a speed of the personal watercraft.

14. The driving control system of claim 12, wherein the operational data is determined based on an angle and a speed of the rotation of the handle.

15. The driving control system of claim 12, wherein the sensor that generates the operational data includes a steering angle sensor, the operational data including the steering angle.

16. The driving control system of claim 15, wherein the at least one controller is configured to implement a feedback loop that adjusts the centering torque applied to the steering system based on updates to the current steering angle and the target angle over time.

17. The driving control system of claim 12, wherein the steering system includes a first control surface and a second control surface, the first and second control surfaces positioned at opposed ends of an aft portion of the personal watercraft, and the at least one controller is configured to:

lower at least one of the first and the second control surfaces into the water, responsive to the controller determining the target angle for returning the steering system to the center position based on the operational data and to a determination that the speed of the personal watercraft is greater than a predefined speed.

18. The driving control system of claim 17, wherein the first and second control surfaces are mechanically linked to the handle, and the at least one controller is configured to:

operate the electrically actuated device to apply the centering torque to the steering system responsive to determining that the user torque is not being applied to the steering system to turn the personal watercraft.

19. A method for enhancing steering control of a jet powered personal watercraft including a jet powered propulsion system, a steering system coupled to the jet powered propulsion system and including a handle for adjusting an angle of the jet powered propulsion system relative to a longitudinal axis of the jet powered personal watercraft, an electrically actuated device coupled to the steering system for applying torque to the steering system, and at least one sensor positioned adjacent the steering system that generates operational data of the jet powered personal watercraft, the method comprising the steps of:

determining whether user torque is being applied to the steering system to turn the personal watercraft; and responsive to determining that the user torque is not being applied to the steering system to turn the personal watercraft:

determining a steering angle of the steering system based on the operational data;

determining a target angle for the steering system for returning the steering system to a center position based on the operational data;

comparing the steering angle to the target angle;

determining a centering torque for returning the steering system to the center position based on the comparison, and operating the electrically actuated device to apply the centering torque to the steering system for providing enhanced steering control of the personal watercraft, with the centering torque being applied only by the electrically actuated device.

20. The method of claim 19, wherein determining the target angle for the steering system comprises determining an engine RPM value, an engine torque request value, and a speed of the personal watercraft.

* * * * *